US007604064B2

(12) United States Patent
Irwin, Jr.

(10) Patent No.: US 7,604,064 B2
(45) Date of Patent: Oct. 20, 2009

(54) MULTI-STAGE, MULTI-PHASE UNITIZED LINEAR LIQUID ENTRAINED-PHASE TRANSFER APPARATUS

(75) Inventor: Charles Chester Irwin, Jr., Columbus, TX (US)

(73) Assignee: ABI Technology, Inc, Houston, TX (US)

( * ) Notice: Subject to any disclaimer, the term of this patent is extended or adjusted under 35 U.S.C. 154(b) by 177 days.

(21) Appl. No.: 11/332,867

(22) Filed: Jan. 17, 2006

(65) Prior Publication Data

US 2007/0166173 A1 Jul. 19, 2007

(51) Int. Cl.
*E21B 43/16* (2006.01)

(52) U.S. Cl. ..... 166/401; 166/302; 166/105; 166/105.6; 417/46; 417/390; 417/403; 417/523

(58) Field of Classification Search ..... 166/357, 166/257, 401, 302, 105, 105.4, 105.6; 417/46, 417/390, 401, 403, 523
See application file for complete search history.

(56) References Cited

U.S. PATENT DOCUMENTS 4,811,558 A * 3/1989 Baugh ..... 60/281
5,450,901 A * 9/1995 Ellwood ..... 166/266
5,863,186 A * 1/1999 Green et al. ..... 417/53
5,937,946 A * 8/1999 Streetman ..... 166/267
5,988,165 A * 11/1999 Richey et al. ..... 128/205.12
6,039,116 A * 3/2000 Stevenson et al. ..... 166/263
6,189,614 B1 * 2/2001 Brady et al. ..... 166/266
6,443,229 B1 * 9/2002 Kulka ..... 166/268
6,516,873 B1 * 2/2003 Haugen ..... 165/145
6,568,911 B1 * 5/2003 Brightwell et al. ..... 417/53
6,691,781 B2 * 2/2004 Grant et al. ..... 166/265
6,769,487 B2 * 8/2004 Hache ..... 166/302
6,805,122 B2 * 10/2004 Richey et al. ..... 128/205.18
7,165,951 B2 * 1/2007 Magami et al. ..... 417/396
2003/0070813 A1 * 4/2003 Irwin, Jr. ..... 166/372
2004/0050549 A1 * 3/2004 Irwin, Jr. ..... 166/302
2004/0134660 A1 * 7/2004 Hall et al. ..... 166/357
2005/0034852 A1 * 2/2005 Irwin, Jr. ..... 166/57
2005/0180864 A1 * 8/2005 Ursan et al. ..... 417/390

* cited by examiner

*Primary Examiner*—Thomas A Beach
*Assistant Examiner*—Matthew R Buck
(74) *Attorney, Agent, or Firm*—Charles Walter

(57) ABSTRACT

An apparatus capable of receiving oil and gas from a recovery or other input source, compressing and/or pumping said oil and gas using multi-phase compressors with heat exchange means, and delivering said compressed gas to various destinations, including for use in oil and gas recovery.

19 Claims, 9 Drawing Sheets

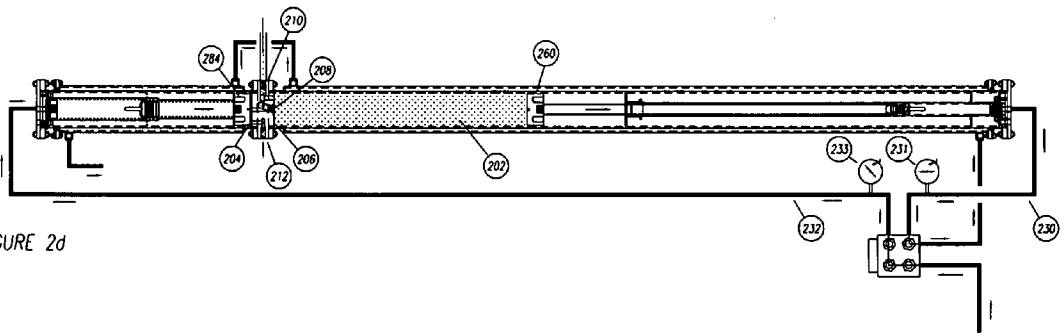
FIGURE 2d
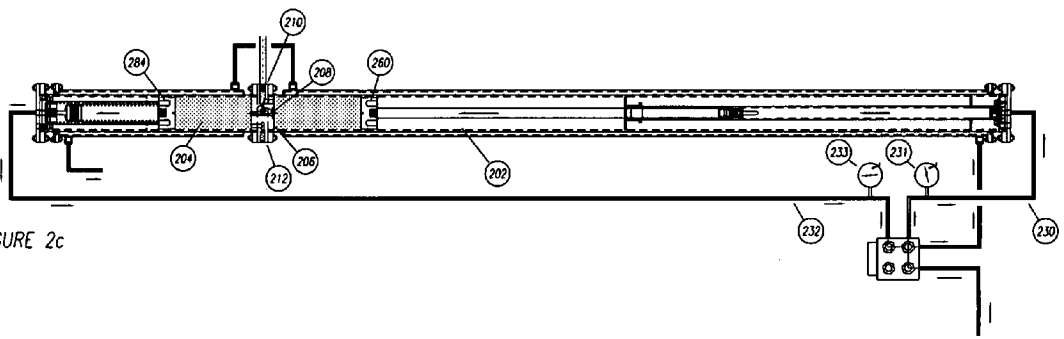
FIGURE 2c
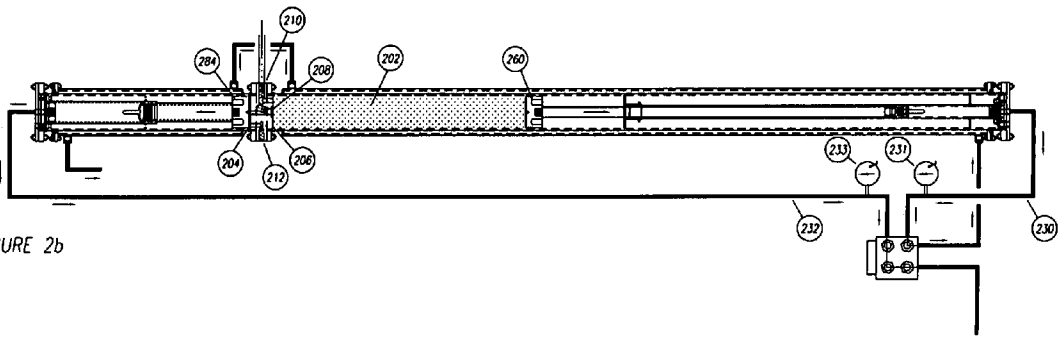
FIGURE 2b
FIGURE 2b, 2c, 2d

MULTI-STAGE, MULTI-PHASE UNITIZED LINEAR LIQUID ENTRAINED-PHASE TRANSFER APPARATUS

FIELD OF THE INVENTION

The present invention relates to a method of multi-stage/multi-phase compression of gases with high liquid contents or gases that phase change during compression such as in refrigeration. The invention further relates to recovery systems that may require heated gases and fluids to enhance oil and gas production. The invention further relates to oil and gas production systems with reduced environmental impact based on utilization of naturally occurring energy and other forces in the well and the process. The invention further relates to compressors controlled by naturally occurring gas from the well. The invention further relates to compressor applications where lack physical space is an issue or the need to directly couple to a wellhead may exist. The invention further relates to compressor applications where lack physical space on a structure such as an offshore or inland water platform may require the compressor to be suspended from part of the structure or submerged in the water. The invention further relates to more cost-effective oil and gas production systems that costs less to purchase, maintain, and operate by eliminating piping and components between stages thus creating a single component compressor.

BACKGROUND OF THE INVENTION

There are a number of ways to raise oil and gas from subterranean formations. Some wells initially have sufficient pressure that well fluids and/or gases flow to the surface and into tanks or pipelines without assistance. Some wells employ pumps and or compressors to bring the oil and/or gases to the surface and finally to the tanks or pipelines. However, even in wells with sufficient pressure initially, the pressure may decrease as the well gets older. When the pressure diminishes to a point where the remaining oil and/or gas is less valuable than the cost of getting it into the tanks or pipeline using secondary recovery methods, (production costs exceed profitability) the remaining oil and/or gas is not raised.

Compressors for this service are expensive, dangerous, require numerous safety devices, and still may pollute the environment. Reciprocating compressors are normally used to achieve the pressure range needed for "gas lifting" technology and pipeline transport. Existing reciprocating compressors are either directly driven by a power source, or indirectly driven via a hydraulic fluid. While both are suitable for compressing "lifting gas" or gas into a pipeline, most prior art reciprocating compressors are costly to operate and maintain. Moreover, existing reciprocating compressors are limited to compressing dry gases because they are not designed to pump both gas and liquids simultaneously and continuously. Prior art hydraulically driven compressors tolerate liquids and high compression ratios better than conventional direct mechanically driven reciprocating compressors, but are limited in how they can be installed and require interconnecting piping and cooling between stages.

Existing compressors use many different forms of speed and volume control. Direct drive and belt drive compressors use cylinder valve unloaders, clearance pockets, and rpm adjustments to control the volume of gas they pump. While these serve the purpose intended, they are expensive and use power inefficiently compared to the present invention. Some prior art compressors use a system of by-passing gas to the cylinders to reduce the volume compressed. This works, but it is inefficient compared to the present invention.

Another example of the inefficiency of prior art technology relates to current means for separating well products. Existing methods employ separators and scrubbers to separate primary components (liquids and gases) so that the gas can be compressed without damaging the compressor. In each case, controls, valves, and accessories add to the cost, environmental impact and maintenance of the equipment.

SUMMARY OF THE INVENTION

The main object of the invention is to provide a more efficient, cost-effective apparatus for compressing and pumping multiple liquid and gaseous phases with entrained phases from oil and gas recovery or other input sources and transferring the compressed gas to various destinations.

The present invention comprises a series of one or more two-stage compressors. Each compressor is housed in a single unit each successive compressor further compresses fluid until the desired state of compression is reached. Each compressor is cooled by a heat-exchange means that may be used as a heat source for other processes. The apparatus is charged with input fluid which is compressed in the first-stage and transferred to the second-stage. When first-stage compression ends, the fluid is isolated in the second stage and compressed further. In embodiments where there are more than two compressor stages, when compression in the previous-stage compressor ends, the fluid is isolated in the next-stage compressor and compressed even further. Eventually, when the fluid is compressed to the final desired pressure, it leaves the system for any of a number of uses or destinations, including for use in oil and gas recovery.

BRIEF DESCRIPTION OF THE DRAWINGS

FIG. 2*b*—Embodiment in FIG. 2*a* charging both compression cylinders with gas.

FIG. 2*c*—Embodiment in FIG. 2*a* compressing gas in its low pressure cylinder and charging its high compression cylinder.

FIG. 2*d*—Embodiment in FIG. 2*d* compressing gas in its high pressure cylinder and recharging its low pressure cylinder.

DETAILED DESCRIPTION OF THE INVENTION

Figure 1:
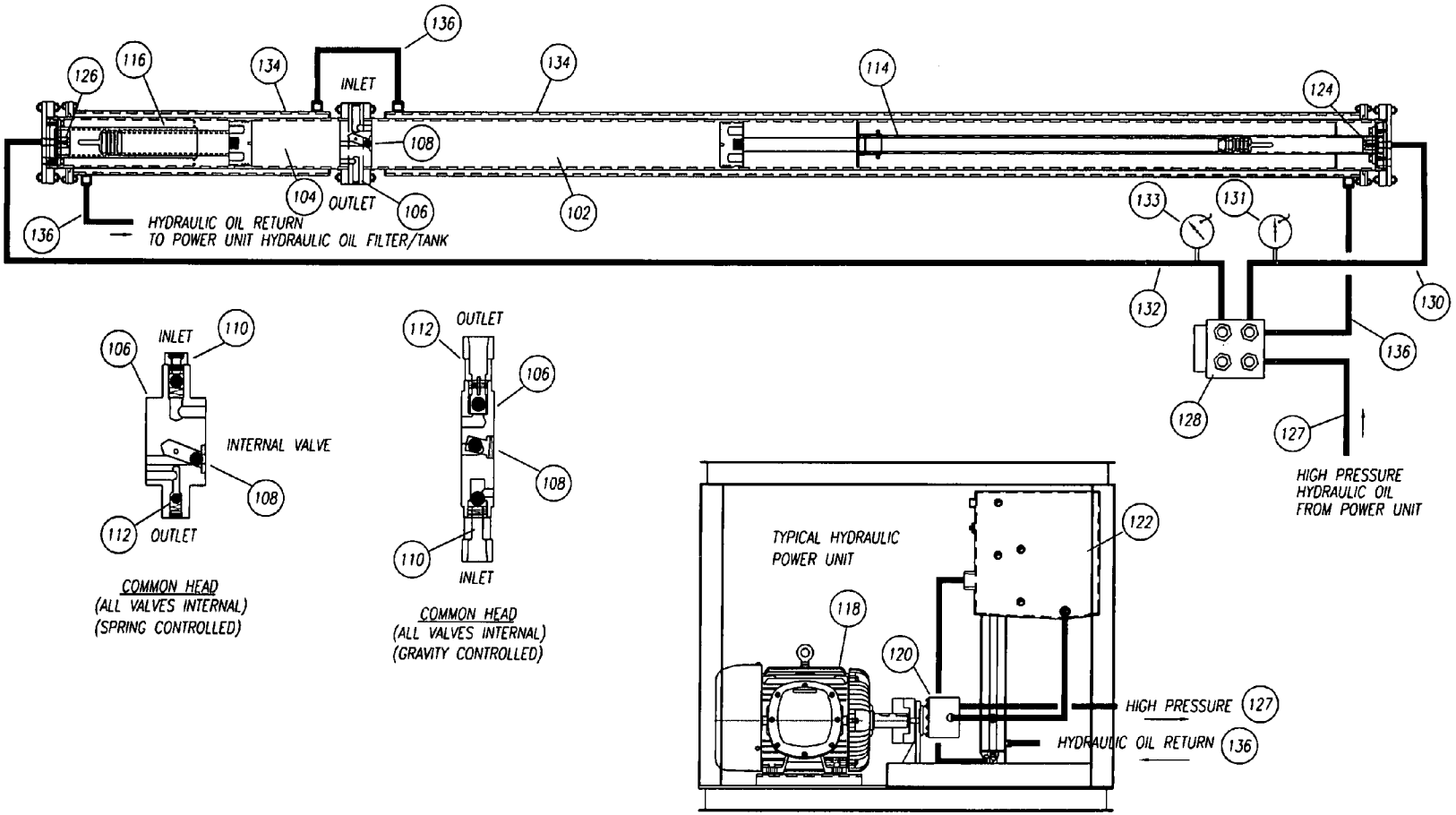
FIG. 1—Two-stage MMULLET with typical hydraulic power unit and spring-controlled or gravity-controlled common head.

The present invention, in its broadest aspect, comprises at least two compressing means housed in a single unit capable of linearly pumping and/or compressing multiple liquid and/or gaseous phases with entrained phases, hence the name, Multi-stage Multi-phase Unitized Linear Liquid Entrained-phase Transfer (MMULLET) apparatus. When coupled with Backwash Production Unit (BPU) technology (Irwin, U.S. Pat. No. 6,644,400 B2), MMULLET retains the advantages of BPU, including the capability of compressing gases and pumping liquids simultaneously.

MMULLET technology may be used in an apparatus for pumping crude oil and/or natural gas from a subterranean formation well bore into a tank or pipeline. The method includes connecting the MMULLET compressor either directly to a well bore or to existing separation equipment and raising the pressure of the fluids and gases to a sufficient pressure as to be injected into a tank or pipeline.

MMULLET technology may also be used in an apparatus for "lifting" oil from a subterranean formation. The method includes connecting the MMULLET as a "gas lift" compressor that may be connected directly to a wellhead to inject hot high pressure saturated gas safely into the well bore. When the gas mixes with crude oil downhole in the well, it forms compressed gas bubbles that "lift" crude oil up through the well to the surface. In this application, separating equipment on the surface may be used to capture a portion of the recovered product for well maintenance and/or for sale or storage, while the MMULLET compressor repeats the "lifting" process by compressing and re-injecting natural gas from the well.

MMULLET technology is particularly attractive for enhancing production of crude oil and compressing gas in that the multiple stages of the compressor utilize a direct connecting integrated head and pumping/compression pressures are controlled by hydraulic ram sizing. In particular, a single cylinder size can accommodate two completely different pressure conditions.

MMULLET technology is also particularly attractive as a cost-effective pump/compressor because it greatly reduces the cost of compressing the lifting gas and pipeline compression of gases and/or fluids produced by the well. This is achieved by simplifying the design to eliminate interconnecting components normally needed in prior art compressors. Where the prior art uses gas compressors and pumps, MMULLET cylinders pumps both gas and liquids simultaneously. Where prior art compressors require coolers, fans, valving, interconnecting piping, and/or separation equipment before each stage of compression, MMULLET cylinders use a common head between two cylinders in the same housing to transfer compressed gas and/or pressurized fluids directly from the lower pressure cylinder into the higher pressure cylinder without any external piping or valving. Where the prior art uses different cylinder sizes for multi-stage compression, MMULLET technology uses one cylinder size for all stages and meets changing pressure/flow requirements by changing the cylinder stroke length. Where the prior art continues to use the same cylinder displacement as production falls, a MMULLET apparatus automatically adjusts its compression and pumping rates and stroke to match the lower pressure and volume of gas.

In addition, MMULLET technology requires substantially fewer moving parts, valves, and piping than does prior art technology. This reduces the hazard of operating the recovery system and further reduces initial costs, as well as maintenance and energy costs. In addition, MMULLET technology requires no pumps for cooling or lubricating, and no sealing packing, thereby further enhancing its cost-effectiveness in recovering natural gas and crude oil.

In addition, mounting MMULLET requires no special alignment, reducing maintenance and downtime.

Another aspect of MMULLET technology is that it has the capability of safely and efficiently inject hot fluid and gases into the well for well bore maintenance without interrupting production. This is achieved by MMULLET's unitized design, which allows it to be incorporated as a single component in the wellhead injection string. Thus, the MMULLET greatly reduces the heat loss that occurs in prior art methods for combating downhole buildup of paraffin and other impediments to the smooth and continuous flow of oil to the well surface.

Another extremely attractive aspect of the MMULLET is that it can be safely operated with no controls or accessories directly attached to it. When hydraulically driven, all functions of MMULLET compressors are limited and controlled by the hydraulic system. This allows the compressor/pump to be installed with a very small footprint or even on offshore platforms by suspending it on the side of or under the platform. The compressor/pump may even be used submerged if necessary.

A Preferred Embodiment of MMULLET Compressor

While FIG. 1 illustrates a 2-stage MMULLET, the present invention includes MMULLETs with as many additional compression stages as needed for the application at hand. Thus, adding similar components to the 2-stage embodiment in FIG. 1 results in multi-stage MMULLETS with more than 2 compression stages. 2-stage MMULLETs may be arranged with their compression chambers in a single cylinder.

Thus, a preferred embodiment of a MMULLET compressor is the two-stage compressor with its two stages of compression in a single unitized component and separated by a common head illustrated in FIG. 1. A common head between two opposing cylinders permits the direct transfer of compressed gas and/or pressurize fluid from the low pressure cylinder into the high pressure cylinder via internal valving, thereby reducing hazards associated with the transfer to the high pressure compression. In this embodiment, the high and low pressure cylinders are of equal diameter, and the low pressure cylinder has a longer stroke than the does high pressure cylinder. To balance the performance between the cylinders, the diameter of the low pressure cylinder ram is smaller than that of the high pressure cylinder ram. This means that, for example, if the low pressure cylinder piston travels 4 times the distance traveled by the high pressure cylinder piston, the larger high pressure ram would require approximately 4 times the hydraulic fluid per inch of travel, and, therefore, travel at about ¼ the velocity of the low pressure piston. It should be apparent to those skilled in the art that these numbers can vary for different applications.

Thus, the embodiment illustrated in FIG. 1 comprises compression cylinder 100 which is divided into a longer (low pressure) chamber 102 and a shorter (high pressure) chamber 104 by common head 106 which contains unidirectional valve 108, which may be set to close whenever it is desired to terminate compression in chamber 102. Inlet valve 110, which may be a spring- or gravity-controlled ball valve incorporated into head 106 or chamber 102, permits the gas to be compressed by MMULLET (GTBC) to flow into chamber 102. Valve 110 opens when the pressure of the gas inside chamber 102 is less than the pressure of the external GTBC and closes when the pressures equalize or, alternatively, when the gas in chamber 102 reaches a pre-set pressure (Initial Pressure). Valve 108 permits gas to flow from chamber 102 into chamber 104 unless the pressure in chamber 102 is less than the pressure in chamber 104, in which case valve 108 is closed. Thus, valve 108 is generally open during the inlet of gas and during the low compression stage, but not during the high compression stage when the pressure in chamber 104 is greater than the pressure in chamber 102. Outlet valve 112, which may also be a spring- or gravity-controlled ball valve incorporated in head 106 or in chamber 104, opens when the pressure of the gas compressed by MMULLET exceeds the pressure of gas outside valve 112 or, alternatively, a pre-set pressure (Outlet Pressure).

Chamber 102 contains first ram compression means 114 and chamber 104 contains second ram compression means 116. Power pack 118 powers pumping means 120 to pump hydraulic fluid from reservoir 122 into ram inlet/outlet (i/o) 124 of means 114 or ram i/o 126 of means 116 via high pressure supply line 127 and bidirectional valve 128. Valve 128 automatically switches back and forth between a first position which directs hydraulic fluid through feed 130 to ram i/o 124 during MMULLET's low compression stage and a second position which directs hydraulic fluid through feed 132 to ram i/o 126 during MMULLET's high compression stage. The pressure in feeds 130 and 132 may be monitored by gauges 131 and 133, respectively. Said hydraulic fluid is recycled back to reservoir 122 via ram i/o 124 and feed 130 and via ram i/o 126 and feed 132, valve 128, heat exchange means 134, and return line 136.

Gas enters valve 110 at Initial Pressure. If there is any compressed gas remaining in chamber 104, it causes ram means 116 to move back toward its retracted position, thereby expelling hydraulic fluid from chamber 104 via ram i/o 126. Gas entering chamber 102 causes ram means 114 to move back to its fully retracted position, thereby expelling hydraulic fluid from chamber 102 via ram i/o 128 and permitting said gas to fill chamber 102. Likewise, if ram means 116 is not already in its fully retracted position, gas entering chamber 104 through valve 108 causes ram means 116 to retract fully, thereby expelling hydraulic fluid from chamber 104 via ram i/o 126 and permitting gas to fill chamber 104. Gas continues to enter through valve 110 until the pressure in chamber 100 reaches Initial Pressure.

The low compression stage begins immediately in chamber 102. Power pack 118 powers pumping means 120 to pump hydraulic fluid from reservoir 122 through bidirectional valve 128 and ram i/o 126. Ram means 114 moves toward head 106, thereby compressing the gas in chamber 100 into the volume of chamber 104 and any remaining volume of chamber 102. When the pressure of the hydraulic fluid reaches a pre-determined pressure, or, alternatively, when ram means reaches head 106, bidirectional valve 128 switches the flow of hydraulic fluid from ram i/o 126 to ram i/o 128, the gas pressure in chamber 102 falls below the pressure in chamber 104, and valve 108 closes, thereby ending the low-compression stage.

The high compression stage begins immediately in chamber 104 when bidirectional valve 128 switches to its second position and pumping means 120 begins pumping hydraulic fluid through ram i/o 128. Ram 116 moves toward head 106, thereby further compressing the gas in chamber 104. When the pressure reaches Outlet Pressure, the compressed gas leaves MMULLET via valve 112.

When chamber 104 empties, bidirectional valve 128 switches back to its first position, and, as chamber 102 refills with GTBC through valve 110, ram means 114 retracts, and hydraulic fluid in chamber 102 returns to reservoir 122 via valve 128, cooling means 134, and return line 136. When the pressure in chamber 102 reaches the pressure in chamber 104, valve 108 opens, ram means 116 retracts, and, as chamber 104 fills with gas, ram means 116 retracts, and hydraulic fluid in chamber 104 returns to reservoir 122. When the MMULLET is recharged with GTBC, valve 110 closes, and pumping means 120 begins pumping hydraulic fluid back to ram i/o 124, thereby beginning another compression in chamber 102.

Figure 2A:
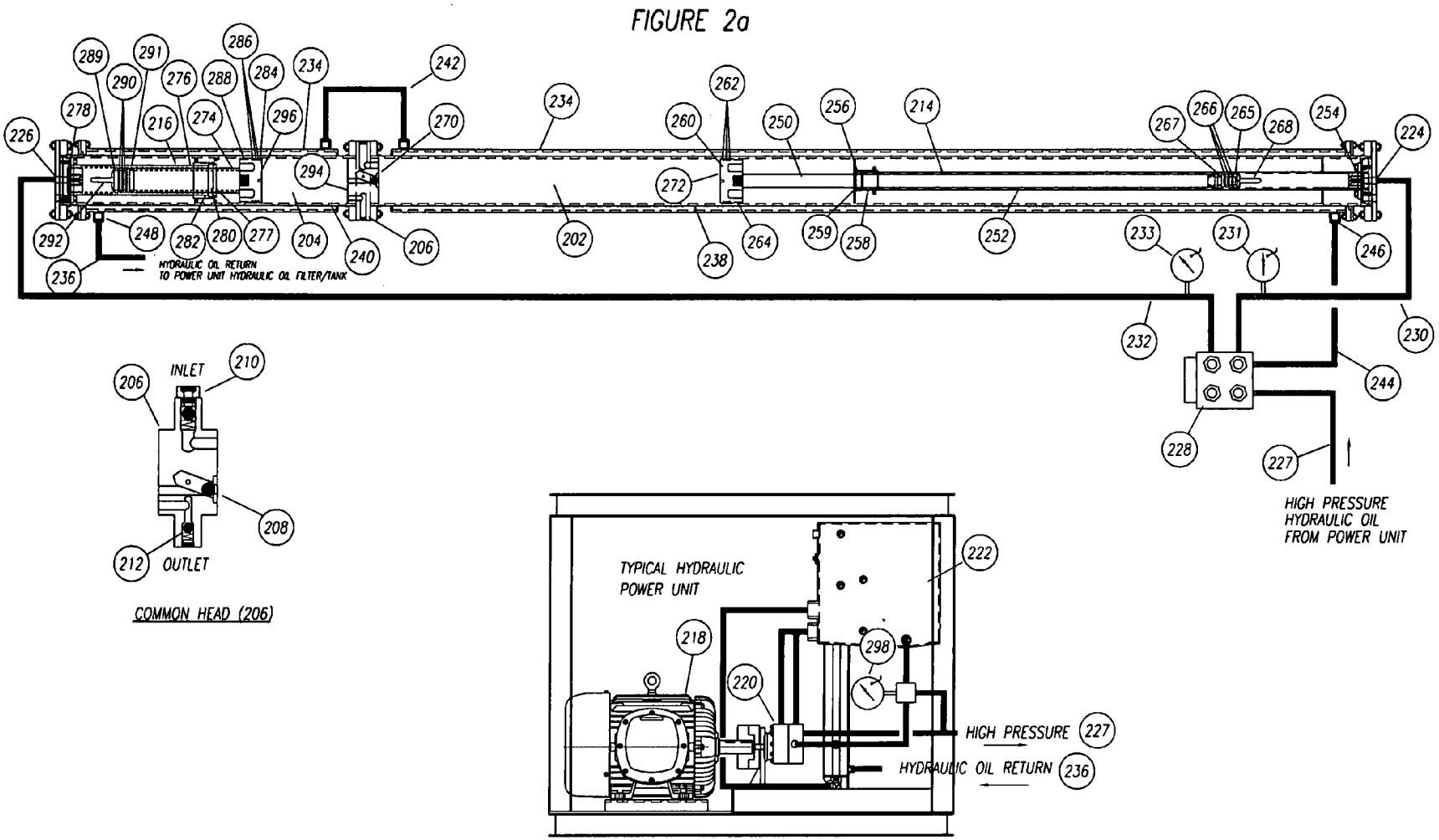
FIG. 2*a*—Preferred embodiment of two-stage MMULLET.

FIG. 2*a* is a preferred embodiment of 2-stage MMULLET cylinder 200 with low compression chamber 202, high compression chamber 204, and common head 206 containing unidirectional transfer valve 208, spring-loaded inlet ball valve 210, spring-loaded outlet spring valve 212, and ram means 214 and 216, and power pack 218. As described in connection with FIG. 1, valve 208 permits gas flow unidirectionally from cylinder 202 into cylinder 204, low pressure chamber 202 is in fluid communication with pumping means 220 and hydraulic fluid reservoir 222 via ram i/o 224, supply line 227, and bidirectional valve 228 when valve 228 is in its first position, and high pressure chamber 204 is in fluid communication with reservoir 222 via ram i/o 226, supply line 227, and valve 228 when valve 228 is in its second position. Valve 228 automatically switches back and forth between a first position which directs hydraulic fluid through feed 230 to ram i/o 224 during MMULLET's low compression stage and a second position which directs hydraulic fluid through feed 232 to ram i/o 226 during MMULLET's high compression stage. The pressure in feeds 230 and 232 may be monitored by gauges 231 and 233, respectively. Said hydraulic fluid is recycled back to reservoir 222 via ram i/o 224 and feed 230 and via ram i/o 226 and feed 232, valve 228, heat exchange means 234, and return line 236.

In the embodiment in FIG. 2*a*, cylinder 200 has an ID of 10", chamber 202 is 190" long, and chamber 204 is 58" long.

In the embodiment in FIG. 2*a*, heat exchange means 234 uses hydraulic fluid to cool MMULLET as said fluid is returned to return line 236 and reservoir 222. Cylinder 200, which has an OD of 10.5", is enclosed in a low compression cooling cylinder 238 and a high compression cooling cylinder 240 with an ID of 12" which are in fluid communication via connector 242. Hydraulic fluid discharged from ram means 214 and ram means 216 flows through valve 228 and cooling supply line 244 into inlet 246 of cylinder 238. Said fluid absorbs heat generated by compression in chamber 202 as it flows through the 0.75" space between the inner diameter of cylinder 238 and the outside of chamber 202, then flows through connector 242 into high compression cooling cylinder 240, where it continues to absorb heat from compression in cylinder 204, and finally exits cooling cylinder 240 via outlet 248 and returns to reservoir 222 via return line 236. Obviously, heat exchange means 234 could be used to heat fluids for various purposes as well as to cool MMULLET.

In the embodiment in FIG. 2*a*, ram means 214 includes moveable hollow shaft 250 and immoveable hollow shaft 252. In the embodiment illustrated in FIG. 2*a*, shaft 252, has an ID of 3.25" and extends into chamber 202 96", but it should be clear that other dimensions could be used for other embodiments. Base 254 of shaft 252 is attached to chamber 202 at ram i/o 224 such that hydraulic fluid entering chamber 202 through ram i/o 224 flows into the hollow core of shaft 252 and external rider band 256 is attached to end 258 of shaft 252 and held by guide cup 259. The ID of shaft 252 is larger that the OD of shaft 250. The difference may be 0.25" to provide a 0.125" clearance between shafts 250 and 252. Thus, the OD of shaft 250 in the embodiment illustrated in FIG. 2*a* is 3.00". Piston 260, piston rings 262, internal rider band 264, hollow piston 265, piston rings 266 and bullet 268 are attached to shaft 250 as indicated in FIG. 2*a*. Piston 260, rings 262 and internal rider band 264 fit snug into the ID of cylinder 202; internal rider band 264, rings 266 and internal rider band 267 fit snugly into the ID of shaft 252; and, when ram means 214 is in its fully retracted position, bullet 268 fits snugly into ram i/o 224. For the embodiment in FIG. 2*a*, the total length of shaft 250, piston 260 and band 264 is 110". Thus, when ram means 214 is in its fully retracted position, the distance between face 270 of common head 206 and head 272 of piston 260 is 80".

In the embodiment in FIG. 2*a*, ram means 216 includes moveable hollow shaft 274 and immoveable hollow shaft 276. In the embodiment illustrated in FIG. 2*a*, shaft 276, has an ID of 5.50" and extends into chamber 204 30", but it should be clear that here too other dimensions could be used for other embodiments. Base 278 of shaft 276 is attached to chamber 204 at ram i/o 226 such that hydraulic fluid entering chamber 204 through ram i/o 226 flows into the hollow core of shaft 276, and external rider band 280 is attached to end 282 of shaft 276 and held by guide cup 277. The ID of shaft 276 is larger than the OD of shaft 274 which is 5.25" in the embodiment illustrated in FIG. 2*a*. Piston 284, piston rings 286, internal rider band 288, hollow piston 289, rings 290, internal rider band 291 and bullet 292 are attached to shaft 274 as indicated in FIG. 2*a*. Piston 284, rings 286 and internal rider band 288 fit snug into the ID of cylinder 204; internal rider band 288 and rings 290 fit snugly into the ID of shaft 276; and, when ram means 216 is in its fully retracted position, bullet 292 fits snugly into ram i/o 226. For the embodiment in FIG. 2*a*, the total length of shaft 274, piston 284 and band 288 is 38". Thus, when ram means 216 is in its fully retracted position, the distance between face 294 of common head 206 and head 296 of piston 284 is 20".

The pumping means employed in the MMULLET may be a single-stage pump, a multi-stage pump, or a pump capable of automatically adjusting its pumping rate to optimize use of the horse power employed to run it. For example, for the embodiment in FIG. 2*a*, power pack 218 may be a gas-driven motor, and pumping means 220 may be a multi-stage HiLo system wherein switching is controlled by preset monitoring valve 298 and each pump contributes equally or unequally to the hydraulic fluid flow. It should be clear, however, that a pump capable of automatically adjusting its function to utilize the full capacity of power pack 218 would be even more efficient, although it would involve additional costs.

FIG. 2*b* illustrates the MMULLET charging both pressure cylinders 202 and 204 with gas. In this configuration transfer valve 208 and inlet valve 210 are open, outlet valve 212 is closed, and gas is entering both cylinders. Piston head 260 and piston head 284 are being pushed away from head 206 by the entering gas. Gauges 231 and 233 indicate the low hydraulic pressure in both supply lines 230 and 232.

FIG. 2*c* illustrates the MMULLET compressing gas in low pressure cylinder 202 while charging high pressure cylinder 204. In this configuration transfer valve 208 is open, inlet valve 210 and outlet valve 212 are closed, and gas is being compressed in both cylinders. Hydraulic fluid is causing piston head 260 to move toward head 206 but piston head 284 is being pushed away from head 206 by the entering gas. Gauge 231 indicates the high hydraulic pressure in supply line 230 for low pressure cylinder 202 and gauge 233 indicates the low hydraulic pressure in supply line 232 for high pressure cylinder 204.

FIG. 2*d* illustrates the MMULLET compressing gas in high pressure cylinder 204 while recharging low pressure cylinder 202. In this configuration, inlet valve 210 is open and gas is entering low pressure chamber 202, transfer valve 208 and outlet valve 212 are closed, but valve 212 will open when the pressure of the gas in cylinder 204 reaches Outlet Pressure so that the compressed gas can leave the MMULLET. Piston head 260 is being pushed away from head 206 by the entering gas, but hydraulic fluid is causing piston head 284 to move toward head 206. Gauge 233 indicates the high hydraulic pressure in supply line 232 and gauge 231 indicates the low hydraulic pressure in supply line 230.

THREE OPERATING EXAMPLES

While MULLET technology is capable of operating in a wide range of inlet and discharge pressure conditions, EXAMPLES I, II, and III are simulations of three typical operating conditions for the 2-stage MMULLET embodiment in FIG. 2*a*. The calculations show the pressure changes, horsepower requirements, and travel speed of the pistons for each inch of travel for stage 1 and stage 2 cylinder performance when the initial temperature of the GTBC is 100 degrees F., power pack 218 in FIG. 2*a* is a gas-driven engine with a horsepower rating of 65 at 3,400 rpm, pumping means 220 is a 2-stage pump with stitching controlled by preset monitoring valve 298 and each pump is contributing equally to the hydraulic flow, and Output Pressure is 1000 psig.

Example 1

Gas from Well Compressed for Storage in Tank

MMULLET inlet gas pressure from well: 50 psig
Required injection pressure to push gas into storage tank: 1000 psig
MMULLET cylinder size 10"
Low pressure ram size: 3.25" Maximum Stroke: 80"
High pressure ram size: 5.5" Maximum Stroke: 20"
Power Unit:
Ford 3.0 liter V-6 engine converted to natural gas with two 25 gpm element pump.
Altitude is sea level
The power pack will be operating at 3400 rpm.
Due to input pressures, the compressor cylinders will travel full stroke.

MMULLET COMPRESSION CALCULATIONS: EXAMPLE Aug. 30, 2005
MCFD: 168.2667 6.657 CYCLES/MIN
CYLINDERS/RAM: 10 * 1/3.25 10 * 1/5.5
PRESSURES: 50 1000 @ 100 F.
PUMP STAGE: 2 25/25 RPM: 3400
FLUID: 0 @ 0 CYCLE/DAY

| TRAVEL | CYLINDER PRESSURE | RAM PRESSURE | VELOCITY | HP/REQUIRED |
|---|---|---|---|---|
| | STAGE ONE CYLINDER PERFORMANCE | | | |
| 1 IN/TRAVEL | 50.000 PSIG GAS PRESS | 612.0 RAM PSI | 1.933 FT/SEC | 21.04 HP |
| 2 IN/TRAVEL | 50.659 PSIG GAS PRESS | 618.3 RAM PSI | 1.933 FT/SEC | 21.26 HP |
| 3 IN/TRAVEL | 51.332 PSIG GAS PRESS | 624.6 RAM PSI | 1.933 FT/SEC | 21.48 HP |
| 4 IN/TRAVEL | 52.020 PSIG GAS PRESS | 631.1 RAM PSI | 1.933 FT/SEC | 21.70 HP |
| 5 IN/TRAVEL | 52.722 PSIG GAS PRESS | 637.8 RAM PSI | 1.933 FT/SEC | 21.93 HP |
| 6 IN/TRAVEL | 53.438 PSIG GAS PRESS | 644.6 RAM PSI | 1.933 FT/SEC | 22.16 HP |
| 7 IN/TRAVEL | 54.170 PSIG GAS PRESS | 651.5 RAM PSI | 1.933 FT/SEC | 22.40 HP |

-continued

| | | | | | |
|---|---|---|---|---|---|
| 8 | IN/TRAVEL | 54.919 PSIG GAS PRESS | 658.6 RAM PSI | 1.933 FT/SEC | 22.64 HP |
| 9 | IN/TRAVEL | 55.683 PSIG GAS PRESS | 665.8 RAM PSI | 1.933 FT/SEC | 22.89 HP |
| 10 | IN/TRAVEL | 56.464 PSIG GAS PRESS | 673.2 RAM PSI | 1.933 FT/SEC | 23.15 HP |
| 11 | IN/TRAVEL | 57.264 PSIG GAS PRESS | 680.8 RAM PSI | 1.933 FT/SEC | 23.41 HP |
| 12 | IN/TRAVEL | 58.081 PSIG GAS PRESS | 688.5 RAM PSI | 1.933 FT/SEC | 23.67 HP |
| 13 | IN/TRAVEL | 58.917 PSIG GAS PRESS | 696.4 RAM PSI | 1.933 FT/SEC | 23.95 HP |
| 14 | IN/TRAVEL | 59.772 PSIG GAS PRESS | 704.5 RAM PSI | 1.933 FT/SEC | 24.22 HP |
| 15 | IN/TRAVEL | 60.648 PSIG GAS PRESS | 712.8 RAM PSI | 1.933 FT/SEC | 24.51 HP |
| 16 | IN/TRAVEL | 61.544 PSIG GAS PRESS | 721.3 RAM PSI | 1.933 FT/SEC | 24.80 HP |
| 17 | IN/TRAVEL | 62.462 PSIG GAS PRESS | 730.0 RAM PSI | 1.933 FT/SEC | 25.10 HP |
| 18 | IN/TRAVEL | 63.403 PSIG GAS PRESS | 738.9 RAM PSI | 1.933 FT/SEC | 25.41 HP |
| 19 | IN/TRAVEL | 64.366 PSIG GAS PRESS | 748.0 RAM PSI | 1.933 FT/SEC | 25.72 HP |
| 20 | IN/TRAVEL | 65.354 PSIG GAS PRESS | 757.4 RAM PSI | 1.933 FT/SEC | 26.04 HP |
| 21 | IN/TRAVEL | 66.367 PSIG GAS PRESS | 767.0 RAM PSI | 1.933 FT/SEC | 26.37 HP |
| 22 | IN/TRAVEL | 67.405 PSIG GAS PRESS | 776.8 RAM PSI | 1.933 FT/SEC | 26.71 HP |
| 23 | IN/TRAVEL | 68.471 PSIG GAS PRESS | 786.9 RAM PSI | 1.933 FT/SEC | 27.06 HP |
| 24 | IN/TRAVEL | 69.565 PSIG GAS PRESS | 797.3 RAM PSI | 1.933 FT/SEC | 27.41 HP |
| 25 | IN/TRAVEL | 70.687 PSIG GAS PRESS | 807.9 RAM PSI | 1.933 FT/SEC | 27.78 HP |
| 26 | IN/TRAVEL | 71.841 PSIG GAS PRESS | 818.8 RAM PSI | 1.933 FT/SEC | 28.15 HP |
| 27 | IN/TRAVEL | 73.026 PSIG GAS PRESS | 830.0 RAM PSI | 1.933 FT/SEC | 28.54 HP |
| 28 | IN/TRAVEL | 74.243 PSIG GAS PRESS | 841.5 RAM PSI | 1.933 FT/SEC | 28.94 HP |
| 29 | IN/TRAVEL | 75.495 PSIG GAS PRESS | 853.4 RAM PSI | 1.933 FT/SEC | 29.34 HP |
| 30 | IN/TRAVEL | 76.783 PSIG GAS PRESS | 865.6 RAM PSI | 1.933 FT/SEC | 29.76 HP |
| 31 | IN/TRAVEL | 78.108 PSIG GAS PRESS | 878.1 RAM PSI | 1.933 FT/SEC | 30.19 HP |
| 32 | IN/TRAVEL | 79.472 PSIG GAS PRESS | 891.1 RAM PSI | 1.933 FT/SEC | 30.64 HP |
| 33 | IN/TRAVEL | 80.877 PSIG GAS PRESS | 904.4 RAM PSI | 1.933 FT/SEC | 31.10 HP |
| 34 | IN/TRAVEL | 82.324 PSIG GAS PRESS | 918.1 RAM PSI | 1.933 FT/SEC | 31.57 HP |
| 35 | IN/TRAVEL | 83.816 PSIG GAS PRESS | 932.2 RAM PSI | 1.933 FT/SEC | 32.05 HP |
| 36 | IN/TRAVEL | 85.355 PSIG GAS PRESS | 946.7 RAM PSI | 1.933 FT/SEC | 32.55 HP |
| 37 | IN/TRAVEL | 86.942 PSIG GAS PRESS | 961.8 RAM PSI | 1.933 FT/SEC | 33.07 HP |
| 38 | IN/TRAVEL | 88.581 PSIG GAS PRESS | 977.3 RAM PSI | 1.933 FT/SEC | 33.60 HP |
| 39 | IN/TRAVEL | 90.273 PSIG GAS PRESS | 993.3 RAM PSI | 1.933 FT/SEC | 34.15 HP |
| 40 | IN/TRAVEL | 92.022 PSIG GAS PRESS | 1009. RAM PSI | 1.933 FT/SEC | 34.72 HP |
| 41 | IN/TRAVEL | 93.830 PSIG GAS PRESS | 1027. RAM PSI | 1.933 FT/SEC | 35.31 HP |
| 42 | IN/TRAVEL | 95.700 PSIG GAS PRESS | 1044. RAM PSI | 1.933 FT/SEC | 35.92 HP |
| 43 | IN/TRAVEL | 97.636 PSIG GAS PRESS | 1063. RAM PSI | 1.933 FT/SEC | 36.55 HP |
| 44 | IN/TRAVEL | 99.641 PSIG GAS PRESS | 1082. RAM PSI | 1.933 FT/SEC | 37.20 HP |
| 45 | IN/TRAVEL | 101.71 PSIG GAS PRESS | 1101. RAM PSI | 1.933 FT/SEC | 37.88 HP |
| 46 | IN/TRAVEL | 103.87 PSIG GAS PRESS | 1122. RAM PSI | 1.933 FT/SEC | 38.58 HP |
| 47 | IN/TRAVEL | 106.11 PSIG GAS PRESS | 1143. RAM PSI | 1.933 FT/SEC | 39.31 HP |
| 48 | IN/TRAVEL | 108.43 PSIG GAS PRESS | 1165. RAM PSI | 1.933 FT/SEC | 40.07 HP |
| 49 | IN/TRAVEL | 110.84 PSIG GAS PRESS | 1188. RAM PSI | 1.933 FT/SEC | 40.85 HP |
| 50 | IN/TRAVEL | 113.35 PSIG GAS PRESS | 1211. RAM PSI | 1.933 FT/SEC | 41.67 HP |
| 51 | IN/TRAVEL | 115.96 PSIG GAS PRESS | 1236. RAM PSI | 1.933 FT/SEC | 42.52 HP |
| 52 | IN/TRAVEL | 118.69 PSIG GAS PRESS | 1262. RAM PSI | 1.933 FT/SEC | 43.41 HP |
| 53 | IN/TRAVEL | 121.52 PSIG GAS PRESS | 1289. RAM PSI | 1.933 FT/SEC | 44.33 HP |
| 54 | IN/TRAVEL | 124.48 PSIG GAS PRESS | 1317. RAM PSI | 1.933 FT/SEC | 45.29 HP |
| 55 | IN/TRAVEL | 127.57 PSIG GAS PRESS | 1346. RAM PSI | 1.933 FT/SEC | 46.30 HP |
| 56 | IN/TRAVEL | 130.81 PSIG GAS PRESS | 1377. RAM PSI | 1.933 FT/SEC | 47.35 HP |
| 57 | IN/TRAVEL | 134.19 PSIG GAS PRESS | 1409. RAM PSI | 1.933 FT/SEC | 48.45 HP |
| 58 | IN/TRAVEL | 137.73 PSIG GAS PRESS | 1442. RAM PSI | 1.933 FT/SEC | 49.61 HP |
| 59 | IN/TRAVEL | 141.45 PSIG GAS PRESS | 1477. RAM PSI | 1.933 FT/SEC | 50.82 HP |
| 60 | IN/TRAVEL | 145.35 PSIG GAS PRESS | 1514. RAM PSI | 1.933 FT/SEC | 52.09 HP |
| 61 | IN/TRAVEL | 149.46 PSIG GAS PRESS | 1553. RAM PSI | 1.933 FT/SEC | 53.42 HP |
| 62 | IN/TRAVEL | 153.78 PSIG GAS PRESS | 1594. RAM PSI | 1.933 FT/SEC | 54.83 HP |
| 63 | IN/TRAVEL | 158.33 PSIG GAS PRESS | 1637. RAM PSI | 1.933 FT/SEC | 56.31 HP |
| 64 | IN/TRAVEL | 163.13 PSIG GAS PRESS | 1683. RAM PSI | 1.933 FT/SEC | 57.88 HP |
| 65 | IN/TRAVEL | 168.21 PSIG GAS PRESS | 1731. RAM PSI | 1.933 FT/SEC | 59.53 HP |
| 66 | IN/TRAVEL | 173.59 PSIG GAS PRESS | 1782. RAM PSI | 1.933 FT/SEC | 61.28 HP |
| 67 | IN/TRAVEL | 179.29 PSIG GAS PRESS | 1836. RAM PSI | .9686 FT/SEC | 31.63 HP |
| 68 | IN/TRAVEL | 185.36 PSIG GAS PRESS | 1893. RAM PSI | .9686 FT/SEC | 32.62 HP |
| 69 | IN/TRAVEL | 191.81 PSIG GAS PRESS | 1954. RAM PSI | .9686 FT/SEC | 33.67 HP |
| 70 | IN/TRAVEL | 198.69 PSIG GAS PRESS | 2019. RAM PSI | .9686 FT/SEC | 34.79 HP |
| 71 | IN/TRAVEL | 206.05 PSIG GAS PRESS | 2089. RAM PSI | .9686 FT/SEC | 35.99 HP |
| 72 | IN/TRAVEL | 213.93 PSIG GAS PRESS | 2164. RAM PSI | .9686 FT/SEC | 37.28 HP |
| 73 | IN/TRAVEL | 222.39 PSIG GAS PRESS | 2244. RAM PSI | .9686 FT/SEC | 38.66 HP |
| 74 | IN/TRAVEL | 231.51 PSIG GAS PRESS | 2330. RAM PSI | .9686 FT/SEC | 40.15 HP |
| 75 | IN/TRAVEL | 241.36 PSIG GAS PRESS | 2423. RAM PSI | .9686 FT/SEC | 41.75 HP |
| 76 | IN/TRAVEL | 252.03 PSIG GAS PRESS | 2524. RAM PSI | .9686 FT/SEC | 43.49 HP |
| 77 | IN/TRAVEL | 263.62 PSIG GAS PRESS | 2634. RAM PSI | .9686 FT/SEC | 45.38 HP |
| 78 | IN/TRAVEL | 276.27 PSIG GAS PRESS | 2754. RAM PSI | .9686 FT/SEC | 47.45 HP |
| 79 | IN/TRAVEL | 290.12 PSIG GAS PRESS | 2885. RAM PSI | .9686 FT/SEC | 49.71 HP |
| 80 | END OF TRAVEL STAGE 1 CYLINDER (Low pressure) | | | | |

STAGE TWO CYLINDER PERFORMANCE

| | | | | | |
|---|---|---|---|---|---|
| 1 | IN/TRAVEL | 306.16 PSIG GAS PRESS | 1060. RAM PSI | .6751 FT/SEC | 36.47 HP |
| 2 | IN/TRAVEL | 323.99 PSIG GAS PRESS | 1119. RAM PSI | .6751 FT/SEC | 38.49 HP |
| 3 | IN/TRAVEL | 343.91 PSIG GAS PRESS | 1185. RAM PSI | .6751 FT/SEC | 40.76 HP |
| 4 | IN/TRAVEL | 366.32 PSIG GAS PRESS | 1259. RAM PSI | .6751 FT/SEC | 43.30 HP |

-continued

| | | | | | |
|---|---|---|---|---|---|
| 5 | IN/TRAVEL | 391.72 PSIG GAS PRESS | 1343. RAM PSI | .6751 FT/SEC | 46.19 HP |
| 6 | IN/TRAVEL | 420.74 PSIG GAS PRESS | 1439. RAM PSI | .6751 FT/SEC | 49.49 HP |
| 7 | IN/TRAVEL | 454.23 PSIG GAS PRESS | 1550. RAM PSI | .6751 FT/SEC | 53.30 HP |
| 8 | IN/TRAVEL | 493.31 PSIG GAS PRESS | 1679. RAM PSI | .6751 FT/SEC | 57.74 HP |
| 9 | IN/TRAVEL | 539.49 PSIG GAS PRESS | 1831. RAM PSI | .3382 FT/SEC | 31.56 HP |
| 10 | IN/TRAVEL | 594.90 PSIG GAS PRESS | 2015. RAM PSI | .3382 FT/SEC | 34.71 HP |
| 11 | IN/TRAVEL | 662.63 PSIG GAS PRESS | 2238. RAM PSI | .3382 FT/SEC | 38.57 HP |
| 12 | IN/TRAVEL | 747.29 PSIG GAS PRESS | 2518. RAM PSI | .3382 FT/SEC | 43.39 HP |
| 13 | IN/TRAVEL | 856.14 PSIG GAS PRESS | 2878. RAM PSI | .3382 FT/SEC | 49.59 HP |
| 14 | IN/TRAVEL | 1000.0 PSIG GAS PRESS | 3354. RAM PSI | .3382 FT/SEC | 57.78 HP |
| 15 | IN/TRAVEL | 1000.0 PSIG GAS PRESS | 3354. RAM PSI | .3382 FT/SEC | 57.78 HP |
| 16 | IN/TRAVEL | 1000.0 PSIG GAS PRESS | 3354. RAM PSI | .3382 FT/SEC | 57.78 HP |
| 17 | IN/TRAVEL | 1000.0 PSIG GAS PRESS | 3354. RAM PSI | .3382 FT/SEC | 57.78 HP |
| 18 | IN/TRAVEL | 1000.0 PSIG GAS PRESS | 3354. RAM PSI | .3382 FT/SEC | 57.78 HP |
| 19 | IN/TRAVEL | 1000.0 PSIG GAS PRESS | 3354. RAM PSI | .3382 FT/SEC | 57.78 HP |
| 20 | END OF TRAVEL STAGE 2 CYLINDER (High pressure) | | | | |

DISCHARGE TEMPERATURE LPC: 238.3878784179688
DISCHARGE TEMPERATURE HPC: 389.1155700683594

Figure 3:
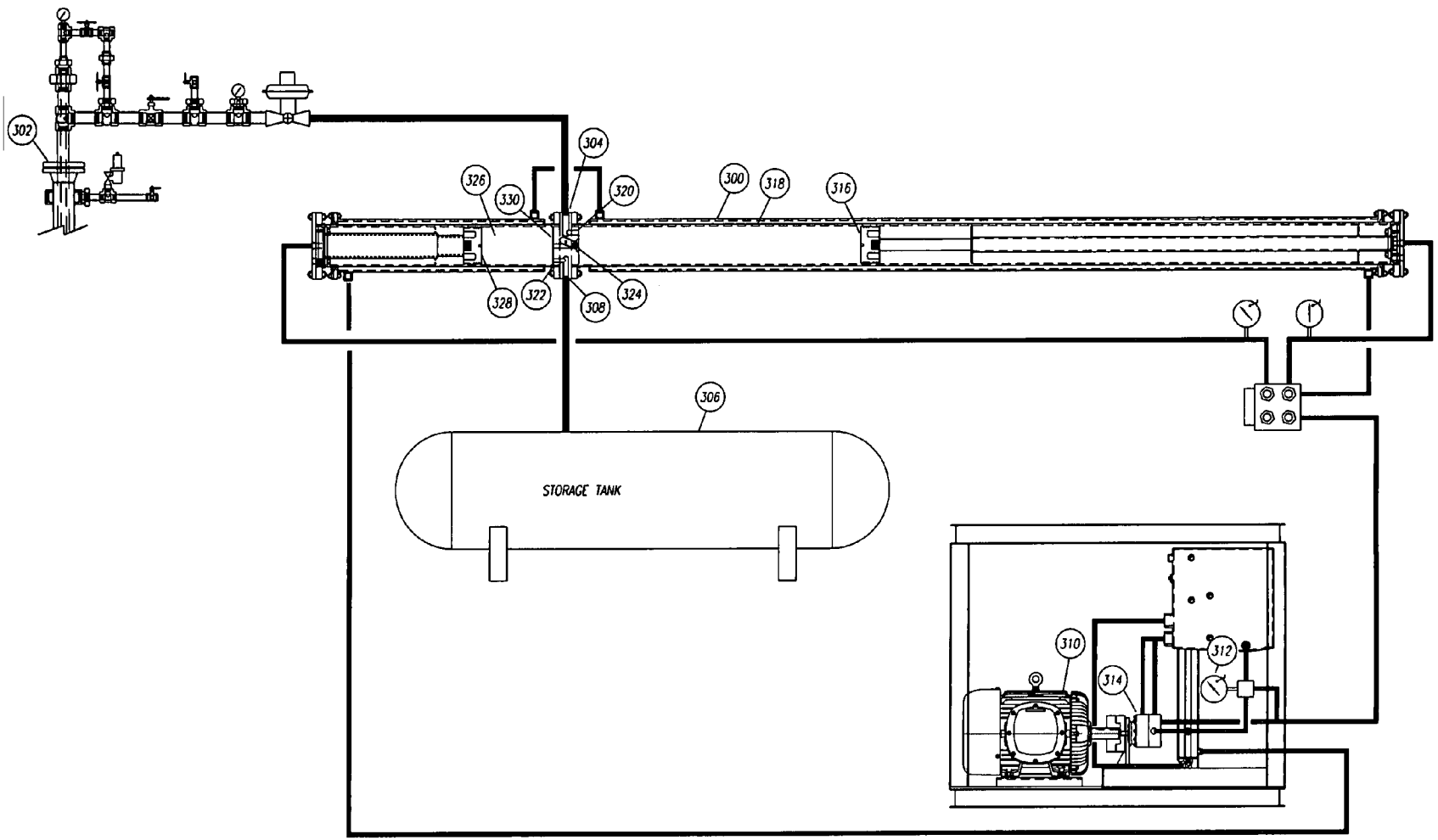
FIG. 3—Apparatus with MMULLET receiving gas from oil and gas well and delivering compressed gas to storage tank.

FIG. 3 illustrates the performance of a MMULLET receiving 50 psi inlet gas from an oil and gas well, compressing said gas as in EXAMPLE I, and delivering said compressed gas to a storage tank at 1000 psig. In that example, MMULLET 300 receives 50 psig gas from oil and gas well 302 via inlet valve 304 and delivers it to destination 306 via outlet valve 308. Stage 1 compression begins at a pump velocity of 1.933 FT/SEC. When ram pressure reaches a first overload point (which may be calculated by the maximum output available from power pack 310), pre-set monitoring valve 312 signals pumping means 314 to recycle the hydraulic fluid flowing through its first pump, thereby switching the pumping velocity to 0.9686 FT/SEC and reducing the horsepower requirement in half. In EXAMPLE I this switching occurs when piston head 316 in low-compression chamber 318 has traveled between 66 and 67 inches and the partially-compressed gas is between 174 and 179 psig, right after the hydraulic pressure was 1782 psi, and the output of power pack 310 reached 61.3 hp. The low-compression stroke continues (utilizing less horsepower at the lower velocity) until piston head 316 reaches face 320 of common head 322 at which point valve 324 closes automatically, thereby isolating the partially-compressed gas in high-compression chamber 326 at a pressure of 290 psig and a temperature of 238 degrees F. Stage 2 compression begins at a velocity of 0.6751 FT/SEC. When the ram pressure reaches the aforementioned first overload point, preset monitoring valve 312 again signals pumping means 314 to delete its first pump, thereby switching the pumping velocity to 0.3382 FT/SEC and reducing the horsepower requirement in half. In EXAMPLE I this switching occurs when piston head 328 has traveled between 8 and 9 inches and the partially-compressed gas is between 493 and 539 psig, right after the hydraulic pressure was 1679 psi, and the output of power pack 310 had reached 57.7 hp. The high-compression stroke continues (again utilizing less horsepower at the lower velocity) until the pressure of the compressed gas reaches 1000 psig, the preset Outlet Pressure, at which time valve 308 opens, thereby permitting head 328 to push the contents of chamber 326 into storage tank 306. When head 328 reaches face 330 of common head 322, valve 308 closes. The discharge temperature of the gas compressed is 389 degrees F.

Example 2

Gas from BPU Compressed for Pipeline

MMULLET inlet gas pressure from BPU: 80 psig

Required injection pressure to push gas into pipeline: 1000 psig

MMULLET cylinder size 10"

Low pressure ram size: 3.25" Maximum Stroke: 80"

High pressure ram size: 5.5" Maximum Stroke: 20"

Power Unit:

Ford 3.0 liter V-6 engine converted to natural gas with two 25 gpm element pump.

Altitude is sea level

The power pack will be operating at 3400 rpm.

Due to input pressures, the low pressure compressor cylinder will only travel 76".

MMULLET COMPRESSION CALCULATIONS: MMULLET2 Aug. 30, 2005
MCFD: 194.1924 6.247 CYCLES/MIN
CYLINDERS/RAM: 10 * 1/3.25 10 * 1/5.5
PRESSURES: 80 1000 @ 100 F.
PUMP STAGE: 2 25/25 RPM: 3400
FLUID: 0 @ 0 CYCLE/DAY

| | TRAVEL | CYLINDER PRESSURE | RAM PRESSURE | VELOCITY | HP/REQUIRED |
|---|---|---|---|---|---|
| | | STAGE ONE CYLINDER PERFORMANCE | | | |
| 1 | IN/TRAVEL | 80.000 PSIG GAS PRESS | 896.0 RAM PSI | 1.933 FT/SEC | 30.81 HP |
| 2 | IN/TRAVEL | 80.965 PSIG GAS PRESS | 905.2 RAM PSI | 1.933 FT/SEC | 31.12 HP |
| 3 | IN/TRAVEL | 81.951 PSIG GAS PRESS | 914.5 RAM PSI | 1.933 FT/SEC | 31.45 HP |
| 4 | IN/TRAVEL | 82.957 PSIG GAS PRESS | 924.0 RAM PSI | 1.933 FT/SEC | 31.77 HP |
| 5 | IN/TRAVEL | 83.985 PSIG GAS PRESS | 933.8 RAM PSI | 1.933 FT/SEC | 32.11 HP |
| 6 | IN/TRAVEL | 85.034 PSIG GAS PRESS | 943.7 RAM PSI | 1.933 FT/SEC | 32.45 HP |

-continued

| | | | | | |
|---|---|---|---|---|---|
| 7 | IN/TRAVEL | 86.106 PSIG GAS PRESS | 953.9 RAM PSI | 1.933 FT/SEC | 32.80 HP |
| 8 | IN/TRAVEL | 87.201 PSIG GAS PRESS | 964.2 RAM PSI | 1.933 FT/SEC | 33.15 HP |
| 9 | IN/TRAVEL | 88.320 PSIG GAS PRESS | 974.8 RAM PSI | 1.933 FT/SEC | 33.52 HP |
| 10 | IN/TRAVEL | 89.464 PSIG GAS PRESS | 985.7 RAM PSI | 1.933 FT/SEC | 33.89 HP |
| 11 | IN/TRAVEL | 90.634 PSIG GAS PRESS | 996.7 RAM PSI | 1.933 FT/SEC | 34.27 HP |
| 12 | IN/TRAVEL | 91.831 PSIG GAS PRESS | 1008. RAM PSI | 1.933 FT/SEC | 34.66 HP |
| 13 | IN/TRAVEL | 93.055 PSIG GAS PRESS | 1019. RAM PSI | 1.933 FT/SEC | 35.06 HP |
| 14 | IN/TRAVEL | 94.307 PSIG GAS PRESS | 1031. RAM PSI | 1.933 FT/SEC | 35.47 HP |
| 15 | IN/TRAVEL | 95.589 PSIG GAS PRESS | 1043. RAM PSI | 1.933 FT/SEC | 35.89 HP |
| 16 | IN/TRAVEL | 96.901 PSIG GAS PRESS | 1056. RAM PSI | 1.933 FT/SEC | 36.31 HP |
| 17 | IN/TRAVEL | 98.245 PSIG GAS PRESS | 1068. RAM PSI | 1.933 FT/SEC | 36.75 HP |
| 18 | IN/TRAVEL | 99.622 PSIG GAS PRESS | 1081. RAM PSI | 1.933 FT/SEC | 37.20 HP |
| 19 | IN/TRAVEL | 101.03 PSIG GAS PRESS | 1095. RAM PSI | 1.933 FT/SEC | 37.66 HP |
| 20 | IN/TRAVEL | 102.47 PSIG GAS PRESS | 1108. RAM PSI | 1.933 FT/SEC | 38.13 HP |
| 21 | IN/TRAVEL | 103.96 PSIG GAS PRESS | 1122. RAM PSI | 1.933 FT/SEC | 38.61 HP |
| 22 | IN/TRAVEL | 105.48 PSIG GAS PRESS | 1137. RAM PSI | 1.933 FT/SEC | 39.11 HP |
| 23 | IN/TRAVEL | 107.04 PSIG GAS PRESS | 1152. RAM PSI | 1.933 FT/SEC | 39.61 HP |
| 24 | IN/TRAVEL | 108.64 PSIG GAS PRESS | 1167. RAM PSI | 1.933 FT/SEC | 40.14 HP |
| 25 | IN/TRAVEL | 110.28 PSIG GAS PRESS | 1182. RAM PSI | 1.933 FT/SEC | 40.67 HP |
| 26 | IN/TRAVEL | 111.97 PSIG GAS PRESS | 1198. RAM PSI | 1.933 FT/SEC | 41.22 HP |
| 27 | IN/TRAVEL | 113.71 PSIG GAS PRESS | 1215. RAM PSI | 1.933 FT/SEC | 41.79 HP |
| 28 | IN/TRAVEL | 115.49 PSIG GAS PRESS | 1232. RAM PSI | 1.933 FT/SEC | 42.37 HP |
| 29 | IN/TRAVEL | 117.32 PSIG GAS PRESS | 1249. RAM PSI | 1.933 FT/SEC | 42.96 HP |
| 30 | IN/TRAVEL | 119.21 PSIG GAS PRESS | 1267. RAM PSI | 1.933 FT/SEC | 43.58 HP |
| 31 | IN/TRAVEL | 121.15 PSIG GAS PRESS | 1285. RAM PSI | 1.933 FT/SEC | 44.21 HP |
| 32 | IN/TRAVEL | 123.14 PSIG GAS PRESS | 1304. RAM PSI | 1.933 FT/SEC | 44.86 HP |
| 33 | IN/TRAVEL | 125.20 PSIG GAS PRESS | 1324. RAM PSI | 1.933 FT/SEC | 45.53 HP |
| 34 | IN/TRAVEL | 127.32 PSIG GAS PRESS | 1344. RAM PSI | 1.933 FT/SEC | 46.22 HP |
| 35 | IN/TRAVEL | 129.50 PSIG GAS PRESS | 1364. RAM PSI | 1.933 FT/SEC | 46.93 HP |
| 36 | IN/TRAVEL | 131.76 PSIG GAS PRESS | 1386. RAM PSI | 1.933 FT/SEC | 47.66 HP |
| 37 | IN/TRAVEL | 134.08 PSIG GAS PRESS | 1408. RAM PSI | 1.933 FT/SEC | 48.42 HP |
| 38 | IN/TRAVEL | 136.48 PSIG GAS PRESS | 1430. RAM PSI | 1.933 FT/SEC | 49.20 HP |
| 39 | IN/TRAVEL | 138.96 PSIG GAS PRESS | 1454. RAM PSI | 1.933 FT/SEC | 50.01 HP |
| 40 | IN/TRAVEL | 141.52 PSIG GAS PRESS | 1478. RAM PSI | 1.933 FT/SEC | 50.84 HP |
| 41 | IN/TRAVEL | 144.16 PSIG GAS PRESS | 1503. RAM PSI | 1.933 FT/SEC | 51.70 HP |
| 42 | IN/TRAVEL | 146.90 PSIG GAS PRESS | 1529. RAM PSI | 1.933 FT/SEC | 52.59 HP |
| 43 | IN/TRAVEL | 149.74 PSIG GAS PRESS | 1556. RAM PSI | 1.933 FT/SEC | 53.52 HP |
| 44 | IN/TRAVEL | 152.67 PSIG GAS PRESS | 1584. RAM PSI | 1.933 FT/SEC | 54.47 HP |
| 45 | IN/TRAVEL | 155.71 PSIG GAS PRESS | 1612. RAM PSI | 1.933 FT/SEC | 55.46 HP |
| 46 | IN/TRAVEL | 158.87 PSIG GAS PRESS | 1642. RAM PSI | 1.933 FT/SEC | 56.49 HP |
| 47 | IN/TRAVEL | 162.14 PSIG GAS PRESS | 1673. RAM PSI | 1.933 FT/SEC | 57.56 HP |
| 48 | IN/TRAVEL | 165.54 PSIG GAS PRESS | 1706. RAM PSI | 1.933 FT/SEC | 58.66 HP |
| 49 | IN/TRAVEL | 169.08 PSIG GAS PRESS | 1739. RAM PSI | 1.933 FT/SEC | 59.81 HP |
| 50 | IN/TRAVEL | 172.75 PSIG GAS PRESS | 1774. RAM PSI | 1.933 FT/SEC | 61.01 HP |
| 51 | IN/TRAVEL | 176.58 PSIG GAS PRESS | 1810. RAM PSI | .9686 FT/SEC | 31.19 HP |
| 52 | IN/TRAVEL | 180.56 PSIG GAS PRESS | 1848. RAM PSI | .9686 FT/SEC | 31.84 HP |
| 53 | IN/TRAVEL | 184.71 PSIG GAS PRESS | 1887. RAM PSI | .9686 FT/SEC | 32.51 HP |
| 54 | IN/TRAVEL | 189.05 PSIG GAS PRESS | 1928. RAM PSI | .9686 FT/SEC | 33.22 HP |
| 55 | IN/TRAVEL | 193.57 PSIG GAS PRESS | 1971. RAM PSI | .9686 FT/SEC | 33.96 HP |
| 56 | IN/TRAVEL | 198.31 PSIG GAS PRESS | 2016. RAM PSI | .9686 FT/SEC | 34.73 HP |
| 57 | IN/TRAVEL | 203.26 PSIG GAS PRESS | 2063. RAM PSI | .9686 FT/SEC | 35.54 HP |
| 58 | IN/TRAVEL | 208.45 PSIG GAS PRESS | 2112. RAM PSI | .9686 FT/SEC | 36.39 HP |
| 59 | IN/TRAVEL | 213.89 PSIG GAS PRESS | 2163. RAM PSI | .9686 FT/SEC | 37.27 HP |
| 60 | IN/TRAVEL | 219.60 PSIG GAS PRESS | 2217. RAM PSI | .9686 FT/SEC | 38.20 HP |
| 61 | IN/TRAVEL | 225.61 PSIG GAS PRESS | 2274. RAM PSI | .9686 FT/SEC | 39.18 HP |
| 62 | IN/TRAVEL | 231.93 PSIG GAS PRESS | 2334. RAM PSI | .9686 FT/SEC | 40.22 HP |
| 63 | IN/TRAVEL | 238.60 PSIG GAS PRESS | 2397. RAM PSI | .9686 FT/SEC | 41.30 HP |
| 64 | IN/TRAVEL | 245.63 PSIG GAS PRESS | 2464. RAM PSI | .9686 FT/SEC | 42.45 HP |
| 65 | IN/TRAVEL | 253.07 PSIG GAS PRESS | 2534. RAM PSI | .9686 FT/SEC | 43.66 HP |
| 66 | IN/TRAVEL | 260.94 PSIG GAS PRESS | 2609. RAM PSI | .9686 FT/SEC | 44.95 HP |
| 67 | IN/TRAVEL | 269.29 PSIG GAS PRESS | 2688. RAM PSI | .9686 FT/SEC | 46.31 HP |
| 68 | IN/TRAVEL | 278.17 PSIG GAS PRESS | 2772. RAM PSI | .9686 FT/SEC | 47.76 HP |
| 69 | IN/TRAVEL | 287.61 PSIG GAS PRESS | 2861. RAM PSI | .9686 FT/SEC | 49.30 HP |
| 70 | IN/TRAVEL | 297.69 PSIG GAS PRESS | 2957. RAM PSI | .9686 FT/SEC | 50.94 HP |
| 71 | IN/TRAVEL | 308.46 PSIG GAS PRESS | 3059. RAM PSI | .9686 FT/SEC | 52.70 HP |
| 72 | IN/TRAVEL | 320.00 PSIG GAS PRESS | 3168. RAM PSI | .9686 FT/SEC | 54.58 HP |
| 73 | IN/TRAVEL | 332.39 PSIG GAS PRESS | 3285. RAM PSI | .9686 FT/SEC | 56.60 HP |
| 74 | IN/TRAVEL | 345.74 PSIG GAS PRESS | 3412. RAM PSI | .9686 FT/SEC | 58.78 HP |
| 75 | IN/TRAVEL | 360.16 PSIG GAS PRESS | 3548. RAM PSI | 3.859 FT/SEC | 60.24 HP |
| 76 | END OF TRAVEL STAGE 1 CYLINDER (Low pressure) | | | | |

STAGE TWO CYLINDER PERFORMANCE

| | | | | | |
|---|---|---|---|---|---|
| 1 | IN/TRAVEL | 379.89 PSIG GAS PRESS | 1304. RAM PSI | .6751 FT/SEC | 44.85 HP |
| 2 | IN/TRAVEL | 401.80 PSIG GAS PRESS | 1376. RAM PSI | .6751 FT/SEC | 47.34 HP |
| 3 | IN/TRAVEL | 426.30 PSIG GAS PRESS | 1457. RAM PSI | .6751 FT/SEC | 50.12 HP |
| 4 | IN/TRAVEL | 453.86 PSIG GAS PRESS | 1548. RAM PSI | .6751 FT/SEC | 53.26 HP |
| 5 | IN/TRAVEL | 485.10 PSIG GAS PRESS | 1652. RAM PSI | .6751 FT/SEC | 56.81 HP |
| 6 | IN/TRAVEL | 520.79 PSIG GAS PRESS | 1770. RAM PSI | .6751 FT/SEC | 60.86 HP |
| 7 | IN/TRAVEL | 561.98 PSIG GAS PRESS | 1906. RAM PSI | .3382 FT/SEC | 32.84 HP |

-continued

| | | | | | |
|---|---|---|---|---|---|
| 8 | IN/TRAVEL | 610.03 PSIG GAS PRESS | 2065. RAM PSI | .3382 FT/SEC | 35.57 HP |
| 9 | IN/TRAVEL | 666.82 PSIG GAS PRESS | 2252. RAM PSI | .3382 FT/SEC | 38.81 HP |
| 10 | IN/TRAVEL | 734.97 PSIG GAS PRESS | 2478. RAM PSI | .3382 FT/SEC | 42.69 HP |
| 11 | IN/TRAVEL | 818.26 PSIG GAS PRESS | 2753. RAM PSI | .3382 FT/SEC | 47.43 HP |
| 12 | IN/TRAVEL | 922.38 PSIG GAS PRESS | 3097. RAM PSI | .3382 FT/SEC | 53.36 HP |
| 13 | IN/TRAVEL | 1000.0 PSIG GAS PRESS | 3354. RAM PSI | .3382 FT/SEC | 57.78 HP |
| 14 | IN/TRAVEL | 1000.0 PSIG GAS PRESS | 3354. RAM PSI | .3382 FT/SEC | 57.78 HP |
| 15 | IN/TRAVEL | 1000.0 PSIG GAS PRESS | 3354. RAM PSI | .3382 FT/SEC | 57.78 HP |
| 16 | IN/TRAVEL | 1000.0 PSIG GAS PRESS | 3354. RAM PSI | .3382 FT/SEC | 57.78 HP |
| 17 | IN/TRAVEL | 1000.0 PSIG GAS PRESS | 3354. RAM PSI | .3382 FT/SEC | 57.78 HP |
| 18 | IN/TRAVEL | 1000.0 PSIG GAS PRESS | 3354. RAM PSI | .3382 FT/SEC | 57.78 HP |
| 19 | IN/TRAVEL | 1000.0 PSIG GAS PRESS | 3354. RAM PSI | .3382 FT/SEC | 57.78 HP |
| 20 | END OF TRAVEL STAGE 2 CYLINDER (High pressure) | | | | |
| DISCHARGE TEMPERATURE LPC: 213.1676177978516 | | | | | |
| DISCHARGE TEMPERATURE HPC: 334.181640625 | | | | | |

Figure 4:
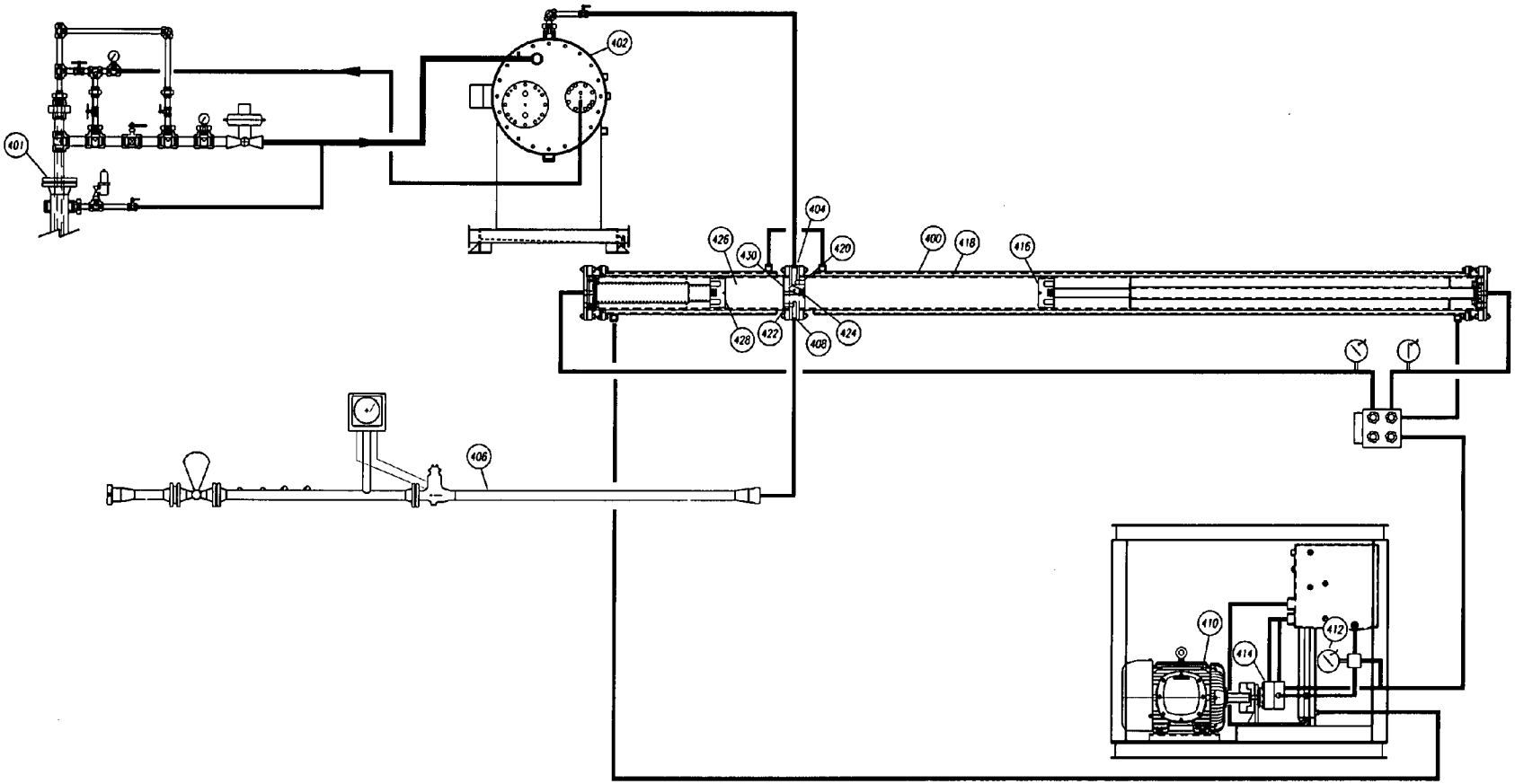
FIG. 4—Apparatus with MMULLET receiving gas from a Backwash Production Unit and delivering compressed gas to pipeline.

FIG. 4 illustrates the performance of a MMULLET receiving 80 psi inlet gas from a BPU lifting system, compressing said gas as in EXAMPLE II, and delivering said compressed gas to a gas pipeline maintained at 1000 psig. In that example, MMULLET 400 receives 80 psig gas from oil and gas well 401 utilizing BPU 402 via inlet valve 404 and delivers it to pipeline 406 via outlet valve 408. Stage 1 compression again begins compressing at a velocity of 1.933 FT/SEC. When ram pressure reaches a first overload point (which may be calculated from the maximum output available from power pack 410), pre-set monitoring valve 412 signals pumping means 414 to delete its first pump, thereby switching the pumping velocity to 0.9686 FT/SEC and reducing the horsepower requirement in half. In Example II this switching occurs when piston head 416 in low-compression chamber 418 has traveled between 50 and 51 inches and the partially-compressed gas is between 173 and 177 psig, right after the hydraulic pressure was 1774 psi, and the output of power pack 410 had reached 61 hp. The low-pressure stroke continues (utilizing less horsepower at the lower velocity) until the ram pressure reaches a second overload point (which may also be calculated from the maximum output available from power pack 410). Although it should be clear that low-pressure compression could be continued by deleting the second pump if a third pump had been in use, since only the 2-pump HiLo system is in use, low-pressure compression must stop or power pack 410 will become overloaded. This is achieved by pre-setting valve 424 to close at the aforementioned second overload point, which is where head 416 has traveled 75 inches and the partially-compressed gas is 360 psig, right after the hydraulic pressure was 3548 psi and the output of power pack 410 had reached 60.2 hp. When valve 424 closes, the partially-compressed gas in high-compression chamber 426 is isolated at a pressure of 360 psig and a temperature of 213 degrees F. Stage 2 compression again begins at a velocity of 0.6751 FT/SEC. When the ram pressure reaches the aforementioned first overload point, pre-set monitoring valve 412 again signals pumping means 414 to delete its second pump, thereby switching the velocity to 0.3382 FT/SEC and reducing the horsepower requirement in half. In Example II, this switching occurs when piston head 428 in high-compression chamber 426 has traveled between 6 and 7 inches, and the partially-compressed gas is between 521 and 562 psig, right after the hydraulic pressure was 1770 psi, and the output of power pack 410 had reached 60.9 hp. The high-compression stroke continues (again utilizing less horsepower at the lower velocity) until the pressure reaches 1000 psig, the pressure of the gas in pipeline 406, at which time valve 408 opens, thereby permitting head 428 to push the contents of chamber 426 out of chamber 426 into pipeline 406 containing gas at 1000 psig. When head 428 reaches face 430 of common head 422, valve 408 closes. The discharge temperature of the gas compressed is 334 degrees F.

Example 3

Gas from Off-Shore Well Compressed for Injection

MMULLET inlet gas pressure from well: 100 psig
Required injection pressure for injection: 1000 psig
MMULLET cylinder size 10"
Low pressure ram size: 3.25" Maximum Stroke: 80"
High-pressure ram size: 5.5" Maximum Stroke: 20"
Power Unit:
Ford 3.0 liter V-6 engine converted to natural gas with two 25 gpm element pump.
Altitude is sea level
The power pack will be operating at 3400 rpm.
Due to input pressures, the low pressure compressor cylinder will only travel 71".

MMULLET COMPRESSION CALCULATIONS: EXAMPLE 2 Aug. 31, 2005
MCFD: 196.0425 6.248 CYCLES/MIN
CYLINDERS/RAM: 10 * 1/3.25 10 * 1/5.5
PRESSURES: 100 1000 @ 100 F.
PUMP: 25 25 RPM: 3400 3400
FLUID: 0 @ 0 CYCLE/DAY

| TRAVEL | CYLINDER PRESSURE | RAM PRESSURE | VELOCITY | HP/REQUIRED |
|---|---|---|---|---|
| STAGE ONE CYLINDER PERFORMANCE | | | | |
| 1 IN/TRAVEL | 100.00 PSIG GAS PRESS | 1085. RAM PSI | 1.933 FT/SEC | 37.32 HP |
| 2 IN/TRAVEL | 101.16 PSIG GAS PRESS | 1096. RAM PSI | 1.933 FT/SEC | 37.70 HP |
| 3 IN/TRAVEL | 102.36 PSIG GAS PRESS | 1107. RAM PSI | 1.933 FT/SEC | 38.09 HP |

-continued

| | | | | | |
|---|---|---|---|---|---|
| 4 | IN/TRAVEL | 103.58 PSIG GAS PRESS | 1119. RAM PSI | 1.933 FT/SEC | 38.49 HP |
| 5 | IN/TRAVEL | 104.82 PSIG GAS PRESS | 1131. RAM PSI | 1.933 FT/SEC | 38.89 HP |
| 6 | IN/TRAVEL | 106.09 PSIG GAS PRESS | 1143. RAM PSI | 1.933 FT/SEC | 39.31 HP |
| 7 | IN/TRAVEL | 107.39 PSIG GAS PRESS | 1155. RAM PSI | 1.933 FT/SEC | 39.73 HP |
| 8 | IN/TRAVEL | 108.72 PSIG GAS PRESS | 1168. RAM PSI | 1.933 FT/SEC | 40.16 HP |
| 9 | IN/TRAVEL | 110.07 PSIG GAS PRESS | 1180. RAM PSI | 1.933 FT/SEC | 40.60 HP |
| 10 | IN/TRAVEL | 111.46 PSIG GAS PRESS | 1193. RAM PSI | 1.933 FT/SEC | 41.05 HP |
| 11 | IN/TRAVEL | 112.88 PSIG GAS PRESS | 1207. RAM PSI | 1.933 FT/SEC | 41.52 HP |
| 12 | IN/TRAVEL | 114.33 PSIG GAS PRESS | 1221. RAM PSI | 1.933 FT/SEC | 41.99 HP |
| 13 | IN/TRAVEL | 115.81 PSIG GAS PRESS | 1235. RAM PSI | 1.933 FT/SEC | 42.47 HP |
| 14 | IN/TRAVEL | 117.33 PSIG GAS PRESS | 1249. RAM PSI | 1.933 FT/SEC | 42.96 HP |
| 15 | IN/TRAVEL | 118.88 PSIG GAS PRESS | 1264. RAM PSI | 1.933 FT/SEC | 43.47 HP |
| 16 | IN/TRAVEL | 120.47 PSIG GAS PRESS | 1279. RAM PSI | 1.933 FT/SEC | 43.99 HP |
| 17 | IN/TRAVEL | 122.10 PSIG GAS PRESS | 1294. RAM PSI | 1.933 FT/SEC | 44.52 HP |
| 18 | IN/TRAVEL | 123.76 PSIG GAS PRESS | 1310. RAM PSI | 1.933 FT/SEC | 45.06 HP |
| 19 | IN/TRAVEL | 125.47 PSIG GAS PRESS | 1326. RAM PSI | 1.933 FT/SEC | 45.62 HP |
| 20 | IN/TRAVEL | 127.22 PSIG GAS PRESS | 1343. RAM PSI | 1.933 FT/SEC | 46.19 HP |
| 21 | IN/TRAVEL | 129.02 PSIG GAS PRESS | 1360. RAM PSI | 1.933 FT/SEC | 46.77 HP |
| 22 | IN/TRAVEL | 130.86 PSIG GAS PRESS | 1377. RAM PSI | 1.933 FT/SEC | 47.37 HP |
| 23 | IN/TRAVEL | 132.75 PSIG GAS PRESS | 1395. RAM PSI | 1.933 FT/SEC | 47.99 HP |
| 24 | IN/TRAVEL | 134.69 PSIG GAS PRESS | 1413. RAM PSI | 1.933 FT/SEC | 48.62 HP |
| 25 | IN/TRAVEL | 136.68 PSIG GAS PRESS | 1432. RAM PSI | 1.933 FT/SEC | 49.27 HP |
| 26 | IN/TRAVEL | 138.73 PSIG GAS PRESS | 1452. RAM PSI | 1.933 FT/SEC | 49.93 HP |
| 27 | IN/TRAVEL | 140.83 PSIG GAS PRESS | 1472. RAM PSI | 1.933 FT/SEC | 50.62 HP |
| 28 | IN/TRAVEL | 142.99 PSIG GAS PRESS | 1492. RAM PSI | 1.933 FT/SEC | 51.32 HP |
| 29 | IN/TRAVEL | 145.21 PSIG GAS PRESS | 1513. RAM PSI | 1.933 FT/SEC | 52.04 HP |
| 30 | IN/TRAVEL | 147.49 PSIG GAS PRESS | 1535. RAM PSI | 1.933 FT/SEC | 52.79 HP |
| 31 | IN/TRAVEL | 149.84 PSIG GAS PRESS | 1557. RAM PSI | 1.933 FT/SEC | 53.55 HP |
| 32 | IN/TRAVEL | 152.26 PSIG GAS PRESS | 1580. RAM PSI | 1.933 FT/SEC | 54.34 HP |
| 33 | IN/TRAVEL | 154.75 PSIG GAS PRESS | 1603. RAM PSI | 1.933 FT/SEC | 55.15 HP |
| 34 | IN/TRAVEL | 157.32 PSIG GAS PRESS | 1628. RAM PSI | 1.933 FT/SEC | 55.98 HP |
| 35 | IN/TRAVEL | 159.97 PSIG GAS PRESS | 1653. RAM PSI | 1.933 FT/SEC | 56.85 HP |
| 36 | IN/TRAVEL | 162.69 PSIG GAS PRESS | 1679. RAM PSI | 1.933 FT/SEC | 57.73 HP |
| 37 | IN/TRAVEL | 165.51 PSIG GAS PRESS | 1705. RAM PSI | 1.933 FT/SEC | 58.65 HP |
| 38 | IN/TRAVEL | 168.42 PSIG GAS PRESS | 1733. RAM PSI | 1.933 FT/SEC | 59.60 HP |
| 39 | IN/TRAVEL | 171.42 PSIG GAS PRESS | 1761. RAM PSI | 1.933 FT/SEC | 60.57 HP |
| 40 | IN/TRAVEL | 174.52 PSIG GAS PRESS | 1790. RAM PSI | 1.933 FT/SEC | 61.58 HP |
| 41 | IN/TRAVEL | 177.72 PSIG GAS PRESS | 1821. RAM PSI | .9686 FT/SEC | 31.37 HP |
| 42 | IN/TRAVEL | 181.04 PSIG GAS PRESS | 1852. RAM PSI | .9686 FT/SEC | 31.91 HP |
| 43 | IN/TRAVEL | 184.47 PSIG GAS PRESS | 1885. RAM PSI | .9686 FT/SEC | 32.47 HP |
| 44 | IN/TRAVEL | 188.03 PSIG GAS PRESS | 1918. RAM PSI | .9686 FT/SEC | 33.05 HP |
| 45 | IN/TRAVEL | 191.72 PSIG GAS PRESS | 1953. RAM PSI | .9686 FT/SEC | 33.66 HP |
| 46 | IN/TRAVEL | 195.54 PSIG GAS PRESS | 1989. RAM PSI | .9686 FT/SEC | 34.28 HP |
| 47 | IN/TRAVEL | 199.50 PSIG GAS PRESS | 2027. RAM PSI | .9686 FT/SEC | 34.93 HP |
| 48 | IN/TRAVEL | 203.62 PSIG GAS PRESS | 2066. RAM PSI | .9686 FT/SEC | 35.60 HP |
| 49 | IN/TRAVEL | 207.90 PSIG GAS PRESS | 2107. RAM PSI | .9686 FT/SEC | 36.30 HP |
| 50 | IN/TRAVEL | 212.35 PSIG GAS PRESS | 2149. RAM PSI | .9686 FT/SEC | 37.02 HP |
| 51 | IN/TRAVEL | 216.98 PSIG GAS PRESS | 2193. RAM PSI | .9686 FT/SEC | 37.78 HP |
| 52 | IN/TRAVEL | 221.81 PSIG GAS PRESS | 2238. RAM PSI | .9686 FT/SEC | 38.56 HP |
| 53 | IN/TRAVEL | 226.84 PSIG GAS PRESS | 2286. RAM PSI | .9686 FT/SEC | 39.39 HP |
| 54 | IN/TRAVEL | 232.09 PSIG GAS PRESS | 2336. RAM PSI | .9686 FT/SEC | 40.24 HP |
| 55 | IN/TRAVEL | 237.57 PSIG GAS PRESS | 2387. RAM PSI | .9686 FT/SEC | 41.14 HP |
| 56 | IN/TRAVEL | 243.31 PSIG GAS PRESS | 2442. RAM PSI | .9686 FT/SEC | 42.07 HP |
| 57 | IN/TRAVEL | 249.31 PSIG GAS PRESS | 2499. RAM PSI | .9686 FT/SEC | 43.05 HP |
| 58 | IN/TRAVEL | 255.59 PSIG GAS PRESS | 2558. RAM PSI | .9686 FT/SEC | 44.07 HP |
| 59 | IN/TRAVEL | 262.18 PSIG GAS PRESS | 2620. RAM PSI | .9686 FT/SEC | 45.15 HP |
| 60 | IN/TRAVEL | 269.10 PSIG GAS PRESS | 2686. RAM PSI | .9686 FT/SEC | 46.28 HP |
| 61 | IN/TRAVEL | 276.38 PSIG GAS PRESS | 2755. RAM PSI | .9686 FT/SEC | 47.47 HP |
| 62 | IN/TRAVEL | 284.04 PSIG GAS PRESS | 2827. RAM PSI | .9686 FT/SEC | 48.71 HP |
| 63 | IN/TRAVEL | 292.11 PSIG GAS PRESS | 2904. RAM PSI | .9686 FT/SEC | 50.03 HP |
| 64 | IN/TRAVEL | 300.63 PSIG GAS PRESS | 2984. RAM PSI | .9686 FT/SEC | 51.42 HP |
| 65 | IN/TRAVEL | 309.64 PSIG GAS PRESS | 3070. RAM PSI | .9686 FT/SEC | 52.89 HP |
| 66 | IN/TRAVEL | 319.18 PSIG GAS PRESS | 3160. RAM PSI | .9686 FT/SEC | 54.45 HP |
| 67 | IN/TRAVEL | 329.30 PSIG GAS PRESS | 3256. RAM PSI | .9686 FT/SEC | 56.10 HP |
| 68 | IN/TRAVEL | 340.04 PSIG GAS PRESS | 3358. RAM PSI | .9686 FT/SEC | 57.85 HP |
| 69 | IN/TRAVEL | 351.49 PSIG GAS PRESS | 3466. RAM PSI | .9686 FT/SEC | 59.72 HP |
| 70 | IN/TRAVEL | 363.69 PSIG GAS PRESS | 3581. RAM PSI | 3.859 FT/SEC | .2458 HP |
| 71 | END OF TRAVEL STAGE 1 CYLINDER | | | | |

STAGE TWO CYLINDER PERFORMANCE

| | | | | | |
|---|---|---|---|---|---|
| 1 | IN/TRAVEL | 383.60 PSIG GAS PRESS | 1316. RAM PSI | .6751 FT/SEC | 45.27 HP |
| 2 | IN/TRAVEL | 405.73 PSIG GAS PRESS | 1389. RAM PSI | .6751 FT/SEC | 47.78 HP |
| 3 | IN/TRAVEL | 430.46 PSIG GAS PRESS | 1471. RAM PSI | .6751 FT/SEC | 50.60 HP |
| 4 | IN/TRAVEL | 458.28 PSIG GAS PRESS | 1563. RAM PSI | .6751 FT/SEC | 53.76 HP |
| 5 | IN/TRAVEL | 489.81 PSIG GAS PRESS | 1667. RAM PSI | .6751 FT/SEC | 57.34 HP |
| 6 | IN/TRAVEL | 525.84 PSIG GAS PRESS | 1786. RAM PSI | .6751 FT/SEC | 61.44 HP |
| 7 | IN/TRAVEL | 567.41 PSIG GAS PRESS | 1924. RAM PSI | .3382 FT/SEC | 33.15 HP |
| 8 | IN/TRAVEL | 615.92 PSIG GAS PRESS | 2084. RAM PSI | .3382 FT/SEC | 35.91 HP |
| 9 | IN/TRAVEL | 673.25 PSIG GAS PRESS | 2274. RAM PSI | .3382 FT/SEC | 39.17 HP |

-continued

| | | | | | |
|---|---|---|---|---|---|
| 10 | IN/TRAVEL | 742.04 PSIG GAS PRESS | 2501. RAM PSI | .3382 FT/SEC | 43.09 HP |
| 11 | IN/TRAVEL | 826.11 PSIG GAS PRESS | 2779. RAM PSI | .3382 FT/SEC | 47.88 HP |
| 12 | IN/TRAVEL | 931.21 PSIG GAS PRESS | 3126. RAM PSI | .3382 FT/SEC | 53.86 HP |
| 13 | IN/TRAVEL | 1000.0 PSIG GAS PRESS | 3354. RAM PSI | .3382 FT/SEC | 57.78 HP |
| 14 | IN/TRAVEL | 1000.0 PSIG GAS PRESS | 3354. RAM PSI | .3382 FT/SEC | 57.78 HP |
| 15 | IN/TRAVEL | 1000.0 PSIG GAS PRESS | 3354. RAM PSI | .3382 FT/SEC | 57.78 HP |
| 16 | IN/TRAVEL | 1000.0 PSIG GAS PRESS | 3354. RAM PSI | .3382 FT/SEC | 57.78 HP |
| 17 | IN/TRAVEL | 1000.0 PSIG GAS PRESS | 3354. RAM PSI | .3382 FT/SEC | 57.78 HP |
| 18 | IN/TRAVEL | 1000.0 PSIG GAS PRESS | 3354. RAM PSI | .3382 FT/SEC | 57.78 HP |
| 19 | IN/TRAVEL | 1000.0 PSIG GAS PRESS | 3354. RAM PSI | .3382 FT/SEC | 57.78 HP |
| 20 | END OF TRAVEL STAGE 2 CYLINDER | | | | |
| DISCHARGE TEMPERATURE LPC: 178.4777069091797 | | | | | |
| DISCHARGE TEMPERATURE HPC: 298.3649597167969 | | | | | |

Figure 5:
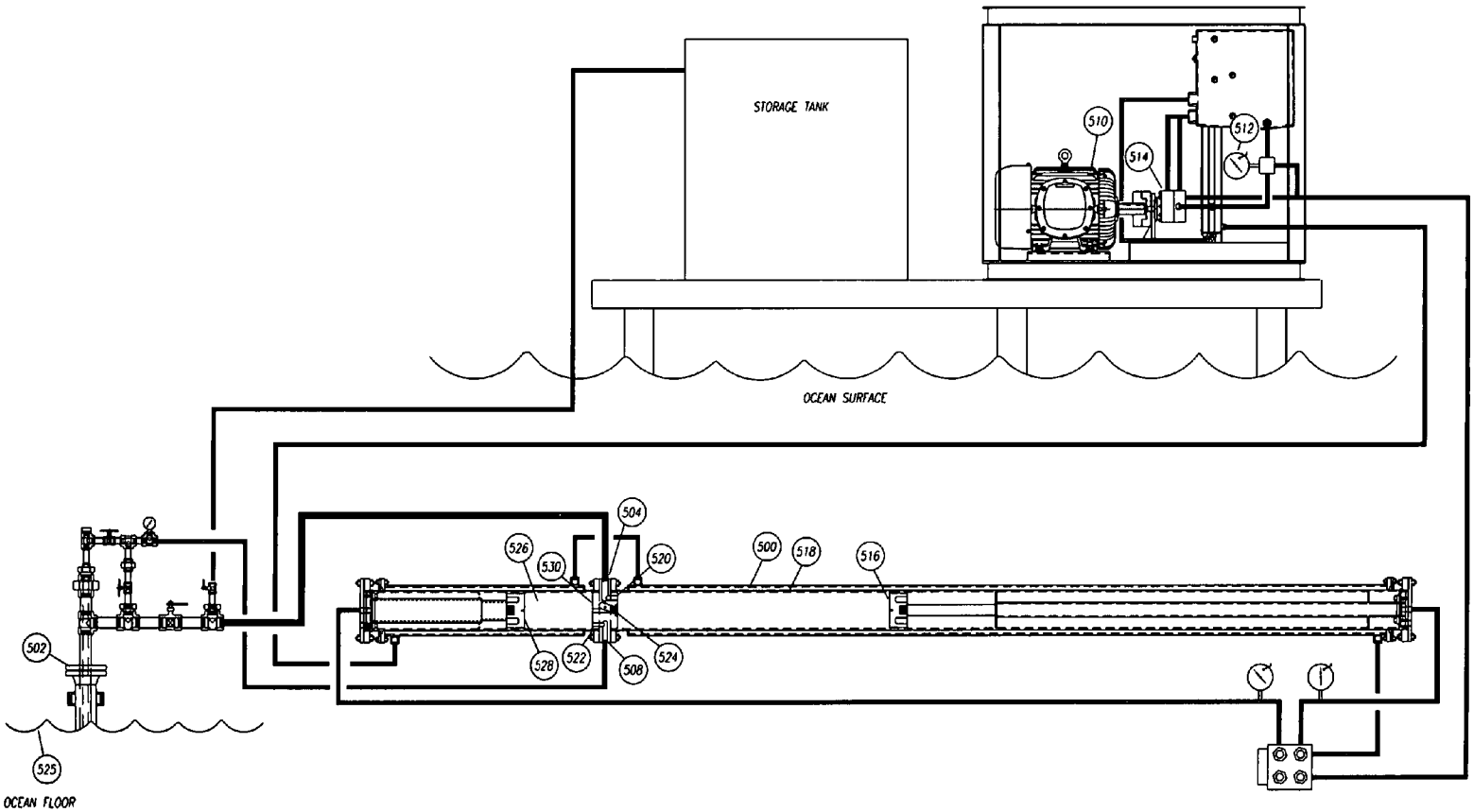
FIG. 5—Apparatus with MMULLET receiving gas from off-shore oil and gas well and injecting compressed gas into said well.

FIG. 5 illustrates the performance of a MMULLET receiving 100 psi inlet gas an oil and gas well which may be submerged on the floor of an ocean, compressing gas as in EXAMPLE III, and injecting said compressed gas into said oil and gas well at 1000 psig to lift subterranean fluids to the surface of the earth, which may be an off-shore platform. In that example, MMULLET 500 receives 100 psig gas from well 502 via inlet valve 504 and injects it into well 502 via outlet valve 508. Stage 1 compression again begins compressing at a velocity of 1.933 FT/SEC. When ram pressure reaches a first overload point (which may be calculated from the maximum output available from power pack 510), pre-set monitoring valve 512 signals pumping means 514 to delete its second pump, thereby switching the pumping velocity to 0.9686 FT/SEC and reducing the horsepower requirement in half. In Example III this switching occurs when piston head 516 in low-compression chamber 518 has traveled between 40 and 41 inches and the partially-compressed gas is between 175 and 178 psig, right after the hydraulic pressure was 1790 psi, and the output of power pack 510 had reached 61.6 hp. The low-pressure stroke continues (utilizing less horsepower at the lower velocity) until the ram pressure reaches a second overload point (which may also be calculated from the maximum output available from power pack 510). Although it should be clear that low-pressure compression could be continued by using a 3-stage pumping means with pumps with different pumping velocities, since only the 2-stage HiLo system is in use, low-pressure pumping must stop. This is achieved by pre-setting valve 524 to close at the aforementioned second overload point, which is where head 516 has traveled 70 inches and the partially-compressed gas is 364 psig, right after the hydraulic pressure was 3581 psi and the output of power pack 510 had reached 60 hp. When valve 524 closes, the partially-compressed gas in high-compression chamber 526 is isolated at a pressure of 364 psig and a temperature of 178 degrees F. Stage 2 compression again begins at a velocity of 0.6751 FT/SEC. When the ram pressure reaches the aforementioned first overload point, pre-set monitoring valve 512 again signals pumping means 514 to delete its second pump, thereby switching the velocity to 0.3382 FT/SEC and reducing the horsepower requirement in half. In Example III, this switching occurs when piston head 528 in high-compression chamber 526 has traveled between 6 and 7 inches, and the partially-compressed gas is between 526 and 567 psig, right after the hydraulic pressure was 1786 psi, and the output of power pack 510 had reached 61.4 hp. The high-compression stroke continues (again utilizing less horsepower at the lower velocity) until the pressure reaches 1000 psig, the preset Outlet Pressure, at which time valve 508 opens, thereby permitting head 528 to push the contents of chamber 526 into oil and gas well 502 which may be submerged on ocean floor 525. When head 528 reaches face 530 of common head 522, valve 508 closes. The discharge temperature of the gas compressed is 298 degrees F.

Figure 6:
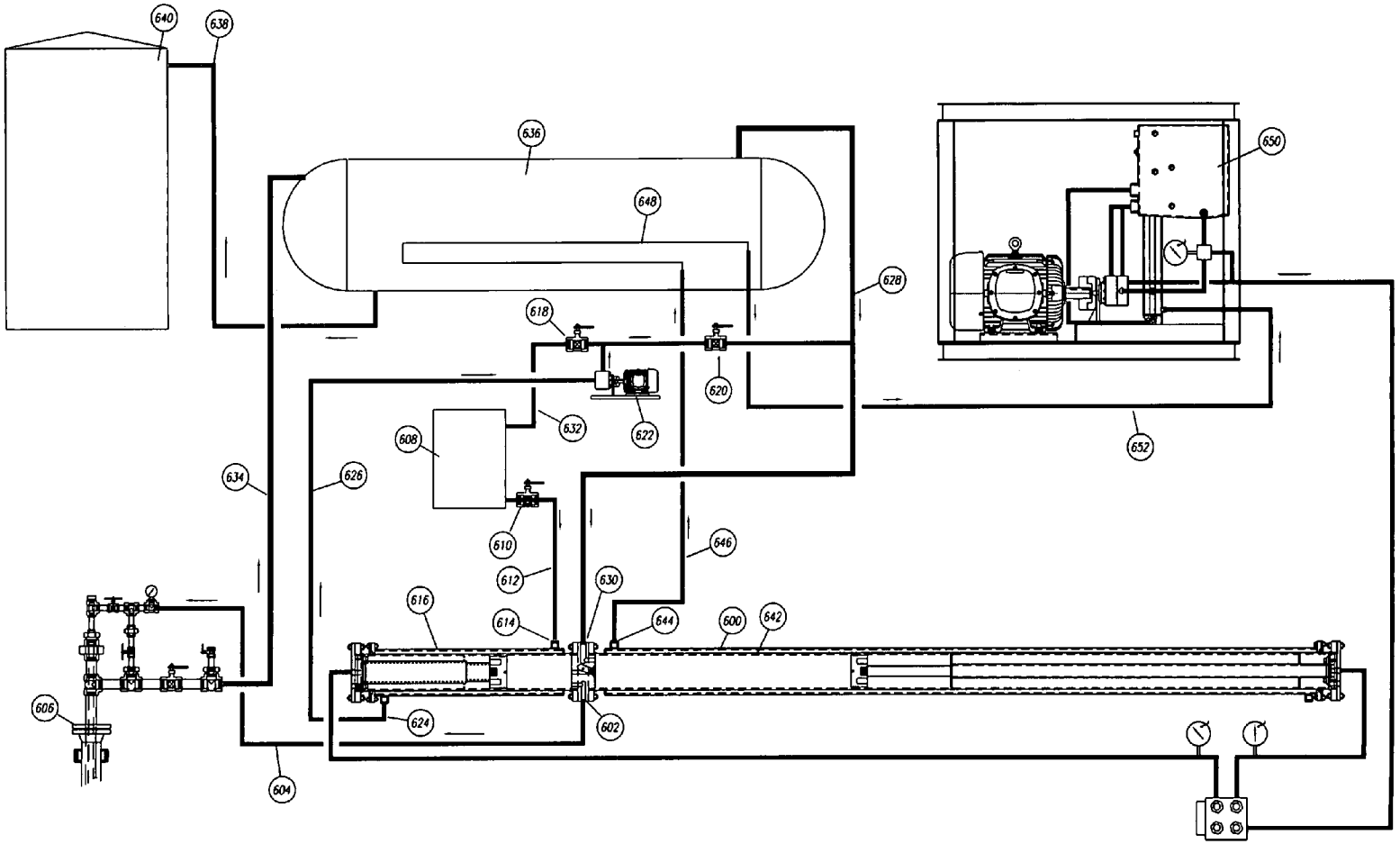
FIG. 6—Apparatus in gas lifting mode with MMULLET heat transfer system used to heat separator and injection chemicals.

FIG. 6 illustrates the use of MMULLET in a gas lifting mode with the heat transfer system used to heat a separator and injection chemicals. In this application, gas compressed in MMULLET 600 leaves the unit via valve 602 and supply line 604 and is injected into well 606 for lifting. Chemicals in tank 608 flow via valve 610, supply line 612 and inlet 614 into high compression cooling cylinder 616 where they are heated. When valve 618 is closed and valve 620 is open, pumping means 622 pumps said chemicals from cylinder 616 via outlet 624 and supply line 626 into supply line 628 and inlet valve 630 where said chemicals are mixed with the gas to be compressed in MMULLET 600 and eventually injected with it into well 606. However, when valve 618 is open and valve 620 is closed, pumping means 622 pumps said chemicals back to tank 608 via supply line 632. In the application illustrated in FIG. 6, the lifted oil and gas and the original injected gas flows from well 606 via supply line 634 to oil and gas separator 636. Oil from separator 636 flows via supply line 638 into oil storage tank 640, and gas from separator 638 is recirculated via supply line 628 to inlet valve 630 of MMULLET 600 where it is re-compressed for injection into well 606. Meanwhile, hydraulic oil heated in low-compression cooling cylinder 642 flows via outlet 644 and supply line 646 into heat transfer means 648 of separator 636, thereby improving oil separation by heating said oil and gas in separator 636, and thence back to reservoir 650 via supply line 652.

Figure 7:
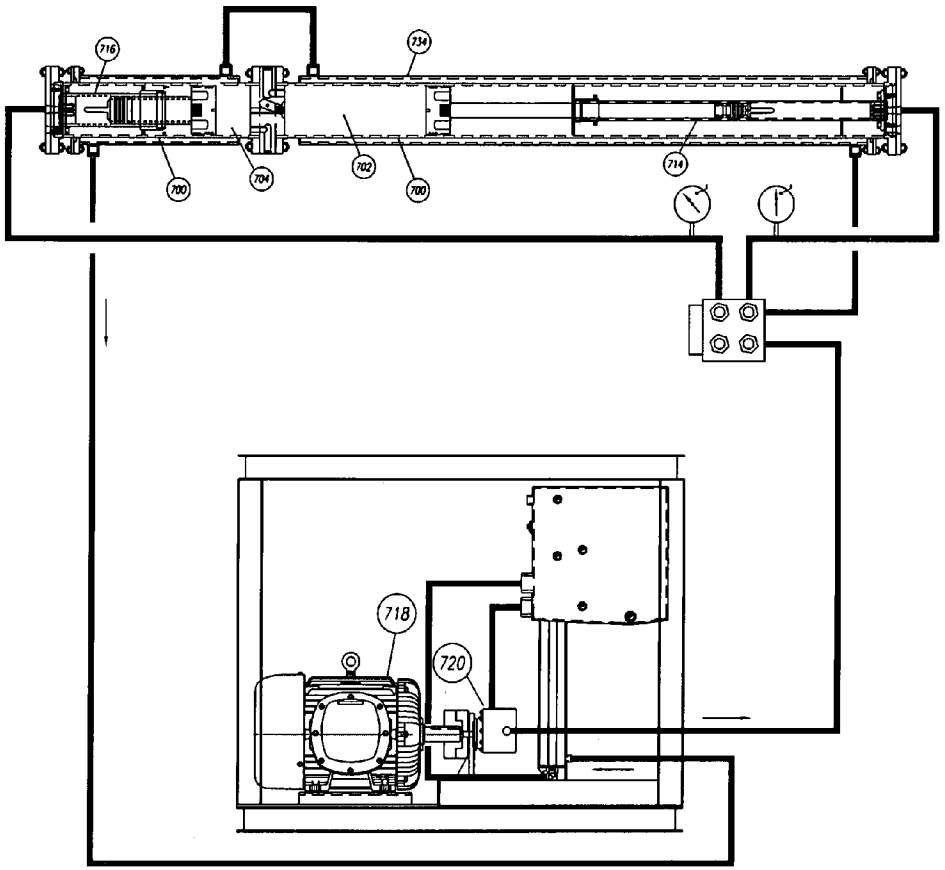
FIG. 7—"Short Stick" MMULLET with smaller compression chambers.

FIG. 7 illustrates a two-stage MMULLET wherein the compression chambers are smaller than those in FIG. 2*a* ("Short Stick"). Specifically, cylinder 700 has an ID of 8", chamber 702 is 40" long, chamber 704 is 10" long, ram means 714 has an ID of 2.625", and ram means 716 has an ID of 4.0", and heat exchanger means 734 has an ID of 10". Short Stick is capable of compressing input gas at 120 degrees F. and 50 psig to 273.33 psig and 228 degrees F. in low-pressure compression chamber 702 and thence to 900 psig and 366 degrees F. in high-pressure compression chamber 704 with single-stage pump 720 powered by 50-HP power pack 718.

Figure 8:
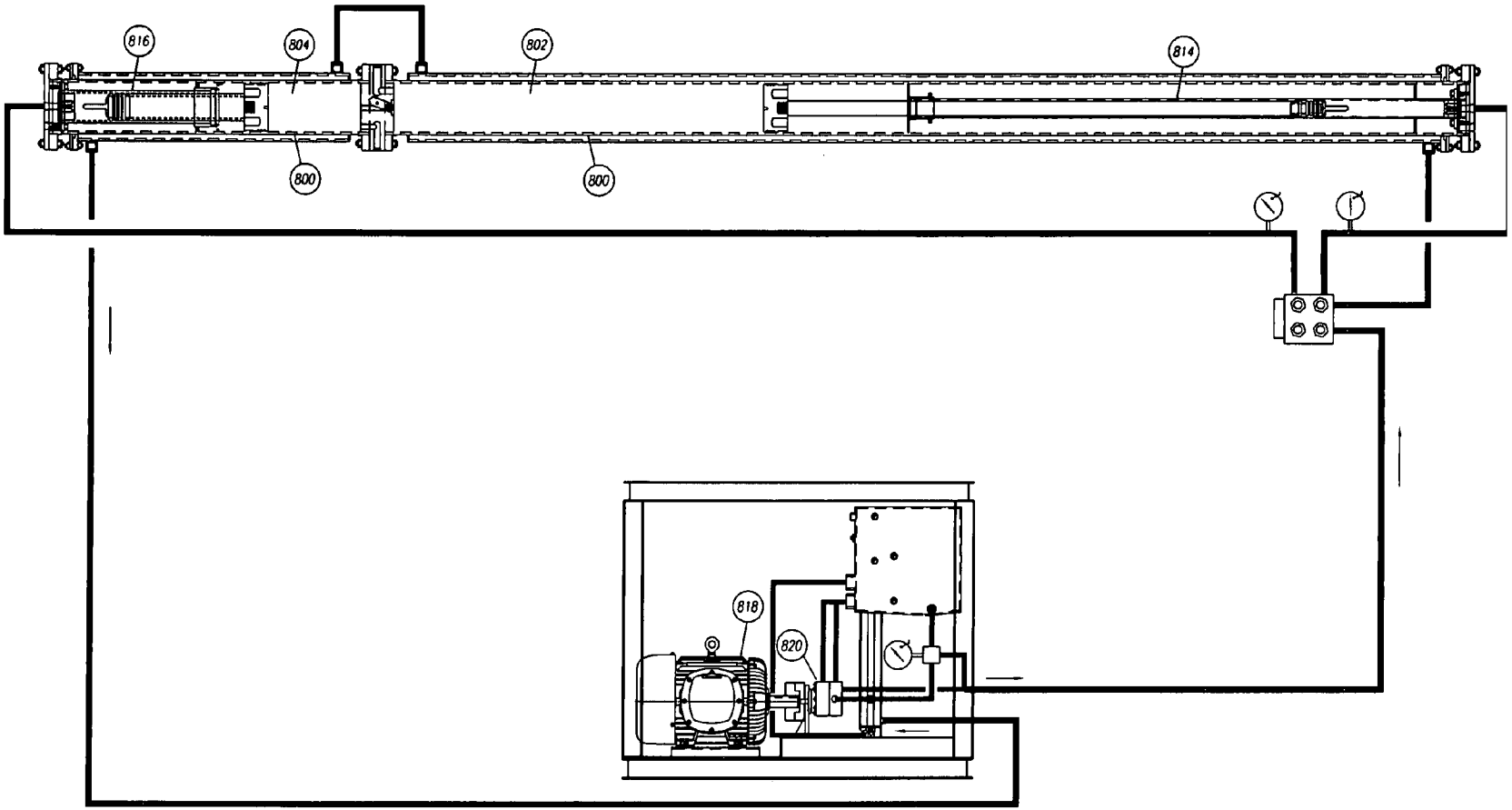
FIG. 8—"Long Stick" MMULLET with larger compression chambers.

FIG. 8 illustrates a two-stage MMULLET wherein the compression chambers are larger than those if FIG. 2*a* ("Long Stick"). Specifically, cylinder 800 has an ID of 13.5", chamber 802 is 110" long, chamber 804 is 28" long, ram means 814 has an ID of 4.0", and ram means 816 has an ID of 7.0".

It should be apparent to those skilled in the art that the MMULLET can be manufactured in varying diameters and lengths to match applications. However, due to practical considerations, MMULLETs in the size range illustrated in here are preferred embodiments because material costs become prohibitive for MMULLET cylinders with diameters greater than that in FIG. 8, and there may be insufficient gas capacity in MMULLETs with compression chambers smaller than those in FIG. 7. The 10" cylinder with 80"/20" strokes illustrated in FIG. 2*a* is the size suited to most applications.

I claim:

1. A multi-stage compressor capable of compressing and pumping multiple liquid and gaseous phases with entrained phases comprising:

a source of input fluid, a first stage compressing means comprising a low-pressure compression cylinder and a low-pressure ram compressing means, a second stage compressing means comprising a high-pressure compression cylinder of equal inside diameter to said low pressure compression cylinder and a high-pressure ram compressing means, a common valve assembly head joining said low-pressure compression cylinder and said high-pressure compression cylinder, a common housing containing said first stage compressing means and said second stage compressing means, a means for activating and deactivating each of said ram compressing means, a multi-directional control means for controlling said activation and deactivation, an inlet means for transferring said input fluid into said compressor and charging said first stage compressing means with gas in said fluid, a fluid transfer means in said common valve assembly head for transferring fluid between said low-pressure compression cylinder and said high-pressure compression cylinder, a compression control means for limiting compression in each of said compressing means, a destination for fluid compressed by said compressor, an outlet means for releasing said compressed fluid from said compressor and transferring it to said destination, heat-exchange means for cooling each of said compressing means, a pumping means for circulating hydraulic fluid to drive said ram compressing means, and a power supply to power said pumping means.

2. The compressor of claim 1 wherein said means for activating and deactivating said compressing means is a bidirectional switch through which hydraulic fluid is pumped to said low-pressure ram means and not to said high-pressure ram means to activate said low-pressure ram means and deactivate said high-pressure ram means and to said high-pressure ram means and not to said low-pressure ram means to activate said high-pressure ram means and deactivate said low-pressure ram means, said multi-directional control means is a bidirectional control valve that switches the flow of hydraulic fluid either to said low-pressure ram means or said high-pressure ram means, said inlet means is a ball valve, which may be gravity controlled or spring-loaded, that provides fluid communication between said low-pressure compression chamber and said inlet fluid when the pressure of fluid inside said low-pressure compression chamber is less than a pre-set value or, if no value is pre-set, the pressure of said inlet fluid, said fluid transfer means is a unidirectional transfer valve in said common valve assembly head between said low-pressure compression cylinder and said high-pressure compression cylinder that can be set to a closing pressure and that provides fluid communication between said low-pressure compression cylinder and said high-pressure compression cylinder unless fluid being compressed in both compression cylinders reaches said closing pressure, or the pressure of fluid in said low-pressure cylinder becomes less than the pressure of fluid in said high-pressure compression cylinder, said outlet means is a ball valve, which may be gravity controlled or spring loaded, that permits said compressed fluid to escape from said high-pressure compression cylinder when said compressed fluid reaches a preset pressure, and said heat exchange means comprises a first-stage cooling jacket that houses said first stage compressing means and a second stage cooling jacket that houses said second stage compressing means.

3. The compressor of claim 2 wherein said compression cylinders have an ID of 10", said low-pressure ram compressing means includes a 3" OD moveable hollow ram shaft housed in said lower-pressure compression means in a 3.25" ID immoveable hollow ram shaft, and a 10" compressing piston capable of moving 80" from its fully retracted position in said first stage compressing means when said low-pressure ram means is activated, and said high-pressure ram compressing means includes a 5.25" OD moveable hollow ram shaft housed in said high-pressure compression means in a 5" ID immoveable hollow ram shaft, and a 10" compressing piston capable of moving 20" from its fully retracted position in said second stage compressing means when said high-pressure ram means is activated.

4. The compressor of claim 2 wherein said compression cylinders have an OD of 10.5", and said heat exchange means is a 12" ID cooling cylinder.

5. The compressor of claim 2 wherein said pumping means is a multi-stage Hi-Lo system with switching controlled by a pre-set monitoring valve.

6. The compressor of claim 2 wherein said pumping means is capable of automatically adjusting its pumping rate to optimize the use of horsepower available from said power supply.

7. The compressor of claim 2 wherein said source of input fluid is an oil and gas well and said destination for said compressed fluid is a storage tank.

8. The compressor of claim 2 wherein said source of input fluid is a BPU lifting system and said destination for said compressed fluid is a pipeline.

9. The compressor of claim 2 wherein said source of input fluid is an oil and gas well submerged on the floor of an ocean.

10. The compressor of claim 2 wherein compressed gas is injected into an oil and gas well for lifting oil from a subterranean formation.

11. The compressor of claim 2 wherein said heat exchange means is used to heat chemicals, said high-stage compression chamber is used to mix said chemicals with gas during compression of said fluid, and said compressed fluid and heated chemicals are injected into an oil and gas well.

12. The compressor of claim 2 wherein said heat exchange means is used to heat oil and gas to facilitate their separation in a separator.

13. The compressor of claim 2 wherein said compression cylinders have an ID of 8", said low-pressure ram compressing means includes a 2.375" OD moveable hollow ram shaft housed in said lower-pressure compression means in a 2.625" ID immoveable hollow ram shaft, and a 8" compressing piston capable of moving 40" from its fully retracted position in said first stage compressing means when said low-pressure ram means is activated, and said high-pressure ram compressing means includes a 3.75" OD moveable hollow ram shall housed in said high-pressure compression means in a 4.0" ID immoveable hollow ram shaft, and a 8" compressing piston capable of moving 10" from its fully retracted position in said second stage compressing means when said high-pressure ram means is activated.

14. The compressor of claim 13 wherein said pumping means is a single-stage pump.

15. The compressor of claim 2 wherein said compression chambers have an ID of 13.5", said low-pressure ram compressing means includes a 3.75" OD moveable hollow ram shaft housed in said low-pressure compression means in a 4.0" ID immoveable hollow ram shaft, and a 13.5" compressing piston capable of moving 110" from its fully retracted position in said first stage compressing means when said low-pressure ram means is activated, and said higher-pressure ram compressing means includes a 6.75" OD moveable hollow ram shaft housed in said higher-pressure compression means in a 7.0" ID immoveable hollow ram shaft, and a 13.5" compressing piston capable of moving 28" from its fully retracted position in said second stage compressing means when said high-pressure ram means is activated.

16. The compressor of claim 2 wherein said source of input fluid is a screw compressor.

17. The compressor of claim 1 wherein said destination is a second compressor of claim 1.

18. The compressor of claim 17 wherein said destination of said second compressor is a third compressor of claim 1.

19. The compressor of claim 1 wherein said destination is a linear series of compressors of claim 1 wherein the destination of each compressor is the next compressor in said linear series.

* * * * *